United States Patent [19]

Nakata et al.

[11] 4,383,157

[45] May 10, 1983

[54] ELECTRONIC CONTROLLED HEAT COOKING APPARATUS AND METHOD OF CONTROLLING THEREOF

[75] Inventors: Takeshi Nakata, Otsu; Hitoshi Takase, Hirakata; Atsushi Horinouchi, Otsu, all of Japan

[73] Assignee: Sanyo Electric Co., Ltd., Moriguchi, Japan

[21] Appl. No.: 109,350

[22] Filed: Jan. 3, 1980

[30] Foreign Application Priority Data

Jan. 20, 1979 [JP] Japan ..... 54-5761

[51] Int. Cl.[3] ..... H05B 6/68

[52] U.S. Cl. ..... 219/10.55 B; 219/10.55 M; 219/10.55 R; 219/494; 219/506; 99/325

[58] Field of Search ..... 219/10.55 B, 10.55 M, 219/10.55 E, 10.55 R, 506, 494, 497; 73/355 R, DIG. 7; 340/584, 588, 589; 99/325, 329 R; 307/310, 358

[56] References Cited

U.S. PATENT DOCUMENTS

| | | | |
|---|---|---|---|
| 3,470,942 | 10/1969 | Fukada et al. | 219/10.55 B |
| 3,766,781 | 10/1973 | Roberts | 73/355 R |
| 4,015,476 | 4/1977 | Roche et al. | 73/355 R |
| 4,130,749 | 12/1978 | Tanaka et al. | 219/10.55 B |
| 4,158,759 | 6/1979 | Mason | 219/10.55 B |
| 4,162,381 | 7/1979 | Buck | 219/10.55 M X |
| 4,191,876 | 3/1980 | Ohkubo et al. | 219/10.55 B |
| 4,210,795 | 7/1980 | Lentz | 219/10.55 B |
| 4,220,840 | 9/1980 | Barker | 219/10.55 R X |

FOREIGN PATENT DOCUMENTS 2917007 10/1979 Fed. Rep. of Germany ... 219/10.55 B

OTHER PUBLICATIONS

Toshiba Ad Brochure, Toshiba Er-798BT 219/10.55B, (Model on Sale in U.S., Apr. 1978).

Texas Instrument Inc., "TMS 1117 Microwave Oven Controller", copyright 1976, Texas Instruments Inc.

*Primary Examiner*—Elliot A. Goldberg
*Assistant Examiner*—Philip H. Leung
*Attorney, Agent, or Firm*—Darby & Darby

[57] ABSTRACT

An infrared radiation detector is provided for receiving an infrared radiation emitted from a material being cooked placed in a cooking chamber in a microwave oven. The microwave oven is provided with a keyboard, a digital display and a microcomputer, such that when a temperature operation mode is set by entry from the keyboard the set temperature data is stored in a memory. In the temperature operation mode, the temperature of the material being cooked is detected in terms of a voltage associated with the output from the infrared radiation detector and a magnetron of the microwave oven is energized until the above described detected voltage becomes equal to the set temperature data and the magnetron is deenergized when both coincide with each other. In the temperature operation mode the temperature of the material being cooked is displayed by the digital display.

23 Claims, 37 Drawing Figures

| KEY | | | SA2, SA1, SA0 |
|---|---|---|---|
| 1 | START | CLOCK | 0 0 1 |
| 2 | STOP | TIMER | 0 1 0 |
| 3 | 0 | POWER | 0 1 1 |
| 4 | 7 | TEMP | 1 0 0 |
| 5 | 8 | DEFROST | 1 0 1 |
| 6 | 9 | CLEAR | 1 1 0 |

| KEY | | CODE |
|---|---|---|
| 0 | | 0 0 0 0 |
| 1 | CLOCK | 0 0 0 1 |
| 2 | TIMER | 0 0 1 0 |
| 3 | POWER | 0 0 1 1 |
| 4 | TEMP | 0 1 0 0 |
| 5 | DEFROST | 0 1 0 1 |
| 6 | CLEAR | 0 1 1 0 |
| 7 | START | 0 1 1 1 |
| 8 | STOP | 1 0 0 0 |
| 9 | | 1 0 0 1 |

103

| DPL / DPH | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 | DISPLAY | | | | PWR B | PWR A | TEMPA | | | | RD | RF | CTL | NKB | KNF | FKB |
| 1 | TIMER | | | | POW-ER | PWR D | TEMPB | | | | | | | | | |
| 2 | | | | | | | TCNT | | | | | | | | | |
| 3 | CLOCK | | | | CNT 1 | | CNT2 | | CNT3 | | | | | | | |

| | | | | |
|---|---|---|---|---|
| KNF | FK | NK | KE | COL |

| | | | | |
|---|---|---|---|---|
| CTL | TP | DF | TM | DPWR |

| | | | | |
|---|---|---|---|---|
| RF | BSY | SET | PWR | SEC |

POWER

STOP
E1
SET=1?
NO
YES
E2
TIMER=0?
NO
YES
E3
TEMPA=0?
NO
YES
E4
TM=1?
YES
D2
NO
K2
G1
BSY ← 0
G2
F1 OFF
G3
F0 OFF
F13
E5
CLEAR DISPLAY
E6
POWER → DISPLAY
E7
DISPLAY / KEY INPUT
E8
FK=1?
NO
YES
E9
START?
YES
START
(FIG. 15F)
NO
E10
CLEAR?
YES
CLEAR
(FIG. 15J)
NO
E11
NK=1?
NO
YES
E12
NKB → POWER
E13
PWR ← 1

START
F1
DOOR CLOSED ?
NO
YES
F2
SET = 1 ?
NO
YES
F3
DF = 1 ?
YES
NO
F36
F4
TEMPA = 0 ?
NO
YES
NO F5
TIMER = 0 ?
YES
BUZZER
(FIG. 15I)
F6
TM = 1 ?
YES
D2
NO
F7
TP = 1 ?
YES
K2
NO
L4
F8
F0 ON
F9
F1 ON
F10
BSY ← 1
F11
POWER → PWRB
F12
PWRA ← 10
F46
F47
F55
F57
F51
F56
G3
F13
DF = 1 ?
NO
YES
NO F15
TM = 1 ?
YES
F14
TEMP B → DISPLAY
(0,2),(0,3)
RD → DISPLAY
(0,1)
F16
TIMER → DISPLAY
F17
DISPLAY / KEY INPUT
F18

BUZZER
I1
F1 OFF
I2
F0 OFF
I3
CNT3 ← 3
I4
F3 ON
NO
I5
TM= 1 ?
YES
I7
TEMP B→DISPLAY
I6
TIMER→DISPLAY
I8
DISPLAY/KEY INPUT
I9
SEC= 1 ?
NO
YES
I10
SEC ← 0
I11
CNT3 − 1

CLEAR
J1
CLEAR RAM
(EXCEPT CLOCK CNT1,2)
A2
I12
CNT3 = 0 ?
NO
YES
I13
F3 OFF
CLEAR
(FIG. 15J)

ELECTRONIC CONTROLLED HEAT COOKING APPARATUS AND METHOD OF CONTROLLING THEREOF

BACKGROUND OF THE INVENTION

1. Field of the Invention

The present invention relates to an electronic controlled heat cooking apparatus and a method of controlling the same. More specifically, the present invention relates to an improvement of a heat cooking apparatus employing a microprocessor for the purpose of controlling a heating condition and a method of controlling the same.

2. Description of the Prior Art

A microwave oven is well-known as an example of a heat cooking apparatus. Of late, a microprocessor implemented by a large scale integration has been employed in such microwave oven for the purpose of performing various cooking functions with a simple circuit configuration and through simple manipulation.

In general, if it is possible to control a heat cooking operation responsive to the temperature of a material being cooked in a heat cooking apparatus, then such a cooking apparatus would be of extreme use.

Conventionally, as such a kind of cooking apparatus, such a cooking apparatus as employing a temperature probe as a temperature measuring means has been proposed and put into practical use. With such a type of cooking apparatus, a temperature probe including a thermistor is inserted into a material being cooked and then the material being cooked in such a state is subjected to heat energy, whereupon control is made of radiation of heat energy responsive to the temperature measured by means of the temperature probe.

Nevertheless, a disadvantage is encountered in such a type of cooking apparatus that since a temperature probe is penetrated into a material being cooked an appearance of the material being cooked is undesirably degraded while the temperature probe need be made clean in using the same. Fatally, a further disadvantage is encountered that a temperature control cannot be made to such a material being cooked as a frozen food material in which a temperature probe can not be inserted.

On the other hand, utilization of an infrared detecting device had been proposed as a temperature measuring means in place of utilizing a temperature probe. Utilization of an infrared detecting device is disclosed in, for example, Japanese Patent Publication No. 24447/1973, published for opposition July 21, 1973, which is of a Japanese patent application filed Jan. 28, 1970 by Hitachi Ltd.. The above referenced Japanese Patent Publication No. 24447/1973 discloses that an infrared radiation emitted from a material being cooked is detected by an infrared detecting device and energization of a magnetron is interrupted upon detection of saturation of the infrared radiation intensity. Thus, the above referenced Japanese patent publication is merely aimed to stop heat cooking only upon detection of saturation of the infrared radiation intensity and can not control a heat cooking operation accurately responsive to the temperature of the material being cooked. Conversely described, even if it is desired to stop heating a material being cooked at a given temperature lower than that corresponding to saturation of the infrared radiation intensity, such as typically in case of defrosting a frozen material, the above referenced Japanese patent publication can not be employed.

Thus, a conventional approach employing an infrared detecting device can not make an accurate temperature control, mainly because a control scheme becomes complicated, which makes it difficult to put the apparatus into practical use.

SUMMARY OF THE INVENTION

A heat cooking apparatus is structured to be capable of performing a temperature operation mode. To that end, the apparatus is adapted such that an infrared radiation detecting device is provided for receiving an infrared radiation emitted from a material being cooked and, when the temperature operation mode is set, heating energy is controlled responsive to the output obtained from the infrared radiation detecting device. The temperature of the material being cooked is displayed in a digital manner.

According to the present invention, heat cooking is performed under accurate temperature control.

In a preferred embodiment of the present invention, in order to detect the temperature of a material being cooked, a changing analog voltage is generated and comparison is made of the analog voltage and the output voltage obtained from the infrared radiation detecting device, thereby to obtain the temperature data of the material being cooked responsive to the analog voltage when both coincide with each other. At that time, the output voltage characteristic of the infrared radiation detecting device is non-linear and therefore the changing analog voltage has also been corrected to exhibit a change similar to the above described nonlinear output voltage characteristic of the infrared radiation detecting device. According to a preferred embodiment of the present invention, accurate and complicated heat cooking that could not be achieved in the past can be done with simplicity.

In a further preferred embodiment of the present invention, in a defrosting operation, the strength of the heating energy is changed between a time period until the temperature of the material being cooked becomes a predetermined value and a period after the temperature of the material being cooked exceeds the predetermined value. As a result, unevenness of the defrosting of the material being cooked does not occur in the defrosting operation.

In a further preferred embodiment of the present invention, a microcomputer is used for controlling the heating energy. Accordingly, a heat cooking apparatus that can perform accurate temperature cooking with a simple structure can be provided.

Accordingly, a principal object of the present invention is to provide an improved electronic controlled heat cooking apparatus.

Another object of the present invention is to provide an electronic controlled heat cooking apparatus that can perform accurate temperature control by the use of an infrared radiation detecting device.

A further object of the present invention is to provide an electronic controlled heat cooking apparatus that can perform accurate temperature control with a simple structure.

Still a further object of the present invention is to provide an electronic controlled heat cooking apparatus which is free from unevenness of defrosting on the occasion of a defrosting operation.

Still another object of the present invention is to provide an electronic controlled heat cooking apparatus that can perform accurate temperature control with simplicity by the use of a microcomputer.

These objects and other objects, features, aspects and advantages of the present invention will become more apparent from the following detailed description when taken in conjunction with the accompanying drawings.

DESCRIPTION OF THE PREFERRED EMBODIMENTS

In the following, the present invention will be described as embodied in a microwave oven; however, the same should not be construed by way of limitation. It should be pointed out that the present invention can be practiced in any other types of heat cooking apparatus for cooking a material being heated such as a food material by heating the same, such as a gas oven, an electrical oven or grill, an electrical roaster or the like.

Figure 1:
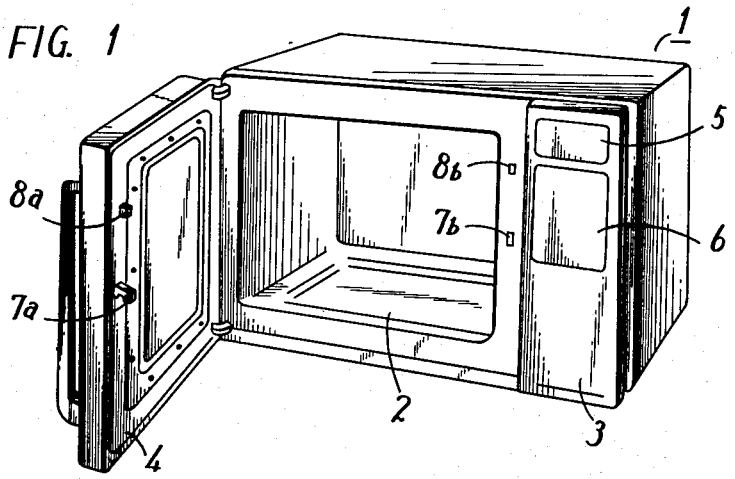
FIG. 1 is a perspective view showing an appearance of a microwave oven embodying the present invention.

FIG. 1 is a perspective view of a microwave oven by way of an embodiment of the present invention. The microwave oven 1 comprises a main body including a cooking chamber 2 and a control panel 3, and a door 4 hinged to the main body to close the opening of the cooking chamber 2. The control panel 3 comprises a display portion 5 for displaying in a digital fashion the information concerning a cooking time period and the like, and an operating portion 6 for manually operating the function of the microwave oven, as to be more fully described subsequently. The door 4 is provided on the inner surface thereof with a door latch 7*a* and a door switch knob 8*a*, so that, when the door 4 is closed, these enter into apertures 7*b* and 8*b* formed at the corresponding portions of the main body to turn on an interlock switch and a door switch, respectively, which are not shown in FIG. 1 and will be described subsequently.

Figure 2:
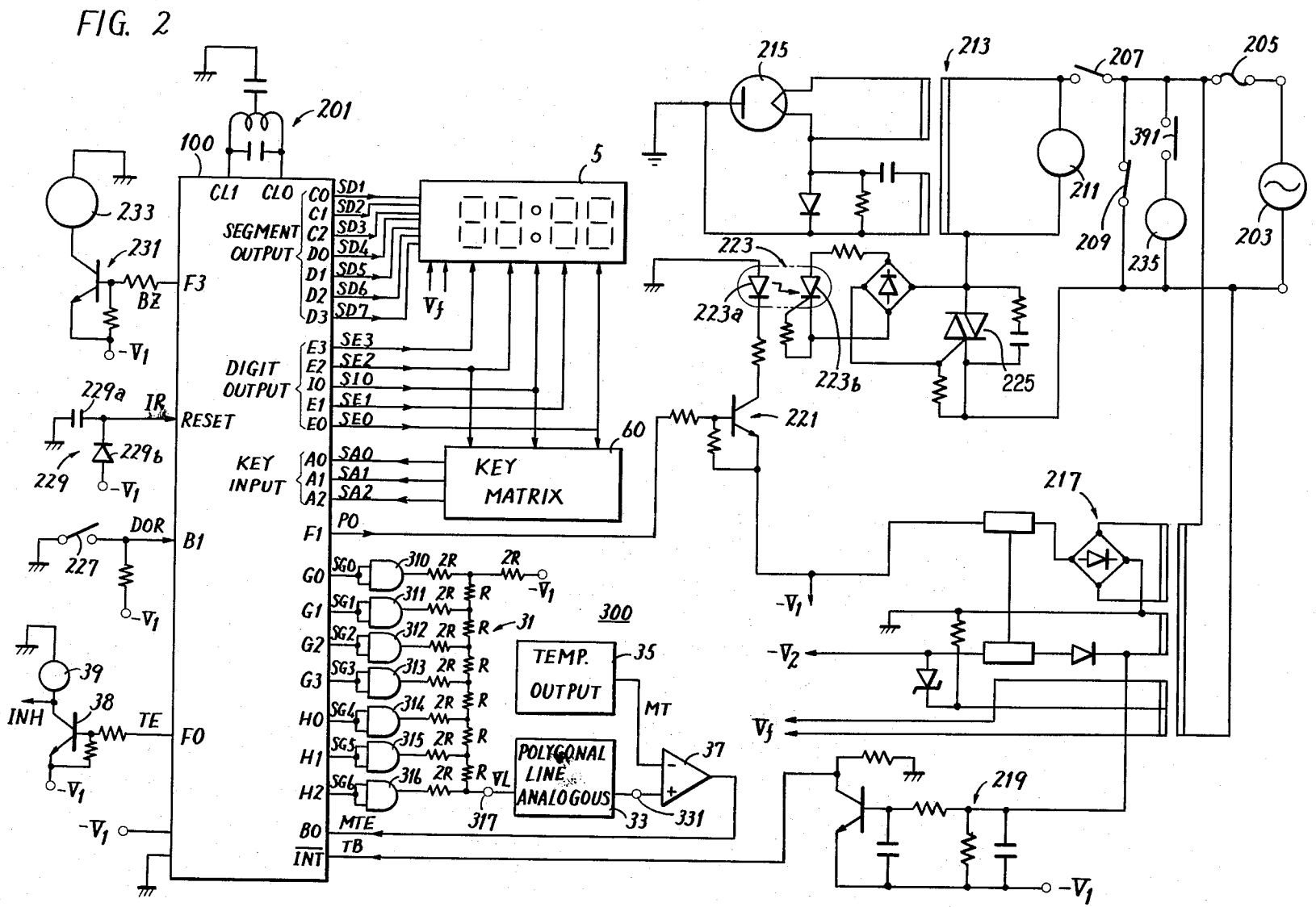
FIG. 2 is a schematic diagram of one embodiment of the present invention.
Figure 4:
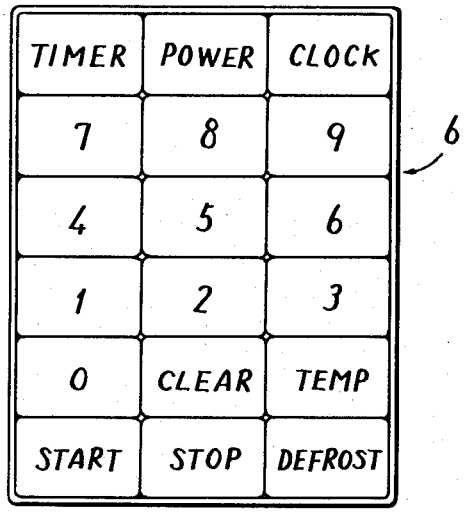
FIG. 4 is a view showing in detail a keyboard or an operating portion.
Figures 5, 6A, 6B:
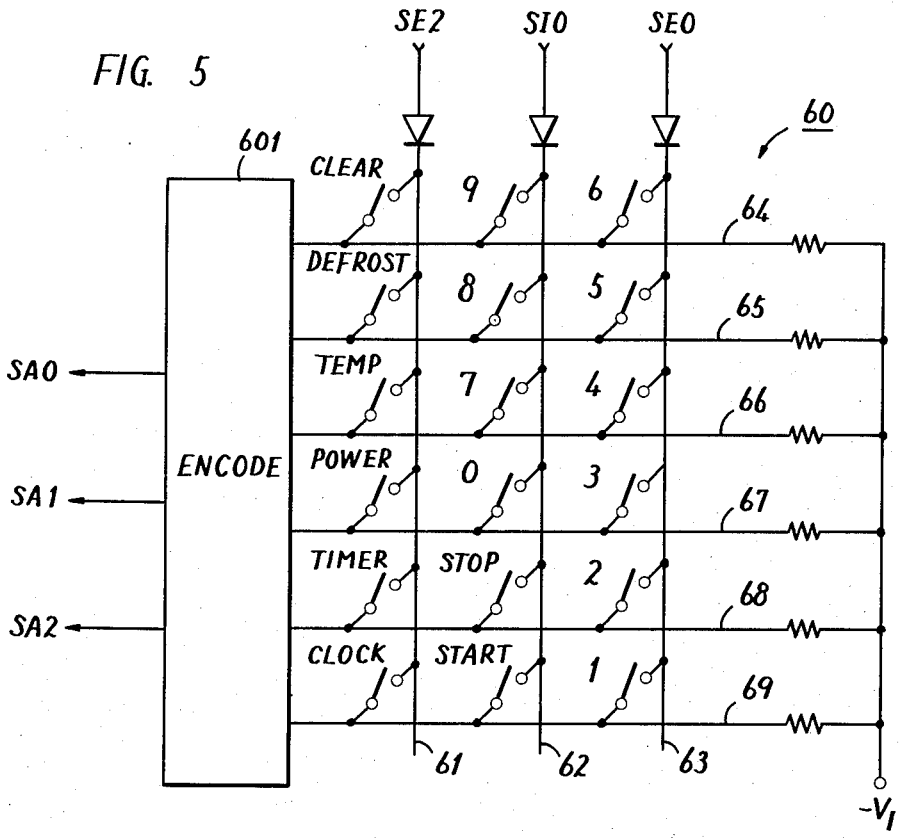
FIG. 5 is a schematic diagram of key matrix of the keyboard.
FIG. 6A is a table showing a relation between the outputs of the key matrix and the respective keys.
FIG. 6B is a table showing a relation between the binary coded decimal code and the respective keys.

FIG. 2 shows a schematic diagram of a preferred embodiment of the present invention. The embodiment shown employs a one chip microprocessor as a control unit. By way of an example of such a microprocessor, a microprocessor, Part No. μPD-553 manufactured by Nippon Electric Company, may be used. Terminals CL1 and CL0 of the microprocessor 100 are connected to an exterior part 201 for the purpose of providing operation clocks of the frequency say 400 kHz to operate the one chip microprocessor 100. The microprocessor 100 is also connected to a keyboard or an operating portion 6 as shown in FIG. 4 to be described subsequently and thus to input lines of a key matrix 60 as shown in FIG. 5 to be described subsequently. The microprocessor 100 is also connected to a segment type digital display portion 5 as shown in FIG. 3 as to be described subsequently. The digital display portion 5 is provided with well-known display data signals or segment selecting signals SD1 to SD7 and control signals or digit selecting signals SE0 and SE3 and SI0 from the microprocessor 100. The digit selecting signals SE0, SE2 and SI0 are also applied to the column lines of the above described key matrix 60. Signals SA0 to SA2 from the row lines of the key matrix 60 are applied to the microprocessor 100.

On the other hand, an alternating current voltage source 203 such as a commercial power supply of 60 Hz is provided. The alternating current voltage source 203 comprises a closed circuit including a fuse 205, an interlock switch 207, a primary winding of a high voltage transformer 213 and a bidirectional thyristor 225. A monitor switch 209 is connected in parallel with the alternating current voltage source 203 through the fuse 205 and the interlock switch 207. The monitor switch 209 operates in the manner directly opposite to that of the interlock switch 207, such that if and when the interlock switch 207 is kept turned on, the fuse 205 is melted. A blower motor 211 is further connected in parallel with the secondary winding of the high voltage transformer 213 through the bidirectional thyristor 225. Accordingly, the blower motor 211 is energized, if and when the bidirectional thyristor 225 is turned on. A synchronous motor 235 is connected through the contact 391 of the relay 39 to the alternating current voltage source 203. The secondary winding of the high voltage transformer 213 is connected to a cathode of a magnetron tube 215. Between the anode and cathode of the magnetron tube 215 is connected a half-wave voltage doubling and rectifying circuit including a third winding of the high voltage transformer 213.

A voltage source circuit 217 is further connected to the alternating current voltage source 203 through the fuse 205. The voltage source circuit 217 comprises a well-known transformer, rectifying circuit and the like to provide direct current operation voltage $-V_1(-10$ V) and $-V_2(-15$ V). One winding of the transformer included in the voltage source circuit 217 is connected to the input of a time base circuit 219. The time base circuit 219 is responsive to the alternating current of the frequency of say 60 Hz obtained from the alternating current voltage source 203 to provide a time base signal TB, which is applied to the input terminal $\overline{INT}$ of the microprocessor 100. The above described time base signal TB is treated as a time base reference signal for controlling a heating time period and for controlling a timing operation.

The microprocessor 100 is also adapted to provide a signal PO from the terminal F1 for turning on or off the voltage source, which is applied to the base electrode of a transistor 221. The emitter electrode of the transistor 221 is connected to a reference voltage $-V_1$. A light-emitting diode 223*a* is connected to the collector electrode of the transistor 221. A photosensitive device 223*b* constituting a photocoupler 223 together with the light-emitting diode 223*a* is connected through the rectifying circuit to the gate electrode of the bidirectional thyristor 225. If and when the control signal PO is obtained from the microprocessor 100 in such a situation, the transistor 221 is also rendered conductive and accordingly the light-emitting diode 223*a* constituting the photocoupler 223 is turned on. As a result, the light-emitting diode 223*a* emits light during the on time period of the transistor 221 and the bidirectional thyristor 225 is rendered conductive responsive to the signal from the photosensitive device 223*b* during the above described on time period of the transistor 221. Thus, it would be appreciated that the magnetron tube 215 is controlled to be turned on or off responsive to the control signal PO obtained from the microprocessor 100. The microprocessor 100 if further connected at a reset terminal RESET to a reset circuit 229. The reset circuit 229 comprises a capacitor 229*a* and a diode 229*b*. Upon turning on of the voltage source, the voltage $-V_1$ is obtained from the voltage source circuit 217 and the capacitor 229*a* is charged, whereby the microprocessor 100 receives through the reset terminal RESET the voltage $-V_1$ as charged in the capacitor 229*a*, whereby the microprocessor 100 is controlled to be reset. The diode 229*b* serves to discharge the capacitor 229*a*, when the voltage source is turned off. The microprocessor 100 is further connected through a terminal F3 to a buzzer driving circuit 231 for driving a buzzer 233 serving as an alarming means. If and when a signal BZ is obtained from the terminal F3 as a high level voltage, the buzzer driving circuit 231 is enabled, whereby the buzzer 233 is energized.

The door switch described in conjunction with FIG. 1 is denoted as 227 in FIG. 2. Accordingly, if and when the door 4 shown in FIG. 1 is closed, the signal DOR of the high level voltage is applied to the terminal B1 of the microprocessor 100. The terminal F0 provides a signal TE on the occasion of a temperature running operation. The signal TE turns the transistor 38 on, thereby to provide a signal INH and to energize the relay 39. Upon energization of the coil 39, the relay contact 391 is turned on.

Terminals G0 to G3 and H0 to H2 provide count signals SG0 to SG6, respectively, on the occasion of a temperature measurement operation. Such count signals SG0 to SG6 of seven bits are applied through impedance converting two-input AND gates 310 to 316 (two inputs have been short circuited) to a temperature measuring circuit 300. The above described count signal outputs SG0 to SG6 of seven bits are counted up on the occasion of a temperature measurement operation starting from the all-zero state, i.e. (000 . . . 0) to be changed to (100 . . . 0), (010 . . . 0), (110 . . . 0) in a binary fashion, The terminal B0 provides a count disable signal MTE, so that the above described count up operation is stopped when the count disable signal is applied.

Figure 3A:
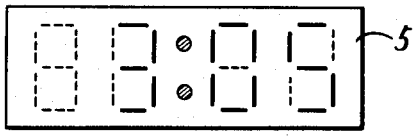
FIGS. 3A to 3E are views showing one example of a display manner by means of a display.
Figure 3B:
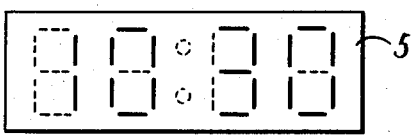
Figure 3C:
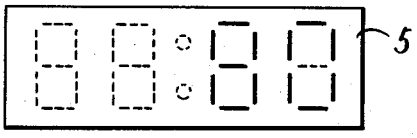
Figure 3D:
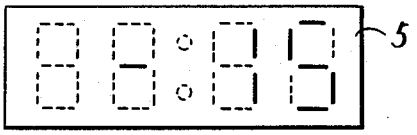
Figure 3E:
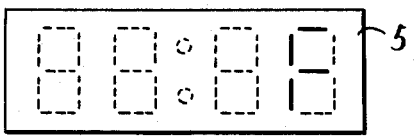

FIGS. 3A and 3B show examples of a display manner by the above described display portion 5. The display portion 5 may comprise well-known fluorescent segment type numeral display tubes and the embodiment is shown as comprising four numeral display digit positions and a colon display position. More specifically, FIG. 3A shows an example of displaying the current time, wherein five minutes past three o'clock is displayed as "3:05" with an indication of the colon mark between the more significant two digit positions and the less significant two digit positions. On the other hand, FIG. 3B shows an example showing a time period left of a predetermined cooking time period on the occasion of a timer operation, without indication of the colon mark, wherein a time period left of ten minutes and thirty seconds is indicated as "1030". FIGS. 3C and 3D show a display manner on the occasion of a temperature running operation and illustrates display examples of 80° C. and −15° C., respectively. FIG. 3E shows a display of a letter F which means a freeze command. The display portion 5 is also used to display other information as entered from the above described operating portion 6.

FIG. 4 shows in detail the above described operating portion 6. The operating portion 6 comprises ten numeral keys allotted for the ten numerals 0, 1, 2, . . . 9, and eight function keys denoted as TIMER, POWER, CLOCK, CLEAR, TEMP, START, STOP and DEFROST. These keys may comprise ordinary push button switches of a contact closable type. The operation sequence and the function of these numeral keys and function keys will be described subsequently.

FIG. 5 shows in detail an electrical connection of a key matrix 60. The operating portion or the keyboard 6 comprises a plurality of keys as shown in FIG. 4 and the matrix 60 comprises a corresponding plurality of switches corresponding to these keys.

Upon receipt of the control signals SE2, SI0 and SE0 from the microporcessor 100, the first column line 61, the second column line 62 and the third column line 63 of these switches of the matrix 60 are supplied with the potentials of these signals SE2, SI0 and SE0, respectively. On the other hand, the first to sixth row lines 64 to 69 of these switches of the matrix 60 are connected to an encoder 601, which is structured to convert the signals at these row lines to a three-bit coded signal, thereby to provide an input data signal of three bits SA0, SA1 and SA2.

Accordingly, depression of any key is detected on the occasion of generation of any of the control signals SE2, SI0 and SE0 and a coded input data signal of three bits SA0, SA1, and SA2 corresponding to the depressed key is obtained. A correlation between these keys and the input data signals is shown in FIGS. 6A. As seen from FIG. 6A, each one of the input data signal is shown allotted to three kind of keys; however, the microprocessor 100 is adapted to discriminate these three keys allotted to each one of the input data signals as a function of synchronization with the control signals SE2, SI0 and SE0. The above described input data signals are treated in the microprocessor 100 as a binary coded decimal (BCD) code signal and a correlation between the input data signals and thus the keys and the BCD codes is shown in FIG. 6B.

The above described display portion 5 comprises the well-known fluorescent segment type numeral display tubes and a driver circuit thereof. For the purpose of dynamic driving of the display portion 5, the control signal SE0 obtained from the microprocessor 100 is used as the first digit selecting signal, the control signal SE1 obtained from the microprocessor 100 is used as the second digit selecting signal, the control signal SE2 obtained from the microprocessor 100 is used as the third digit selecting signal, and the control signal SE3 obtained from the microprocessor 100 is used as the fourth digit selecting signal, while the display data signals SD1 to SD7 obtained from the microprocessor 100 are used as the segment selecting signals of the respective digits. Accordingly, if and when the display data signals SD1, SD3, SD4, SD5 and SD7 are obtained while the control signal SE0 is obtained, it follows that the numeral "2" is displayed at the second digit, for example, and so on. The display portion 5 is further structured such that the control signal SI0 is used as a colon digit selecting signal and the display data signal SD6 as a colon selecting signal, so that the colon may be displayed as a function of both signals SI0 and SD6.

The above described temperature measuring circuit 300 comprises a resistor ladder circuit 31, a polygonal line analogous circuit 33, a temperature output circuit 35 and a comparator 37 and the output signal of the comparator 37 is withdrawn as a signal MTE applied to the above described terminal B0.

Figure 8:
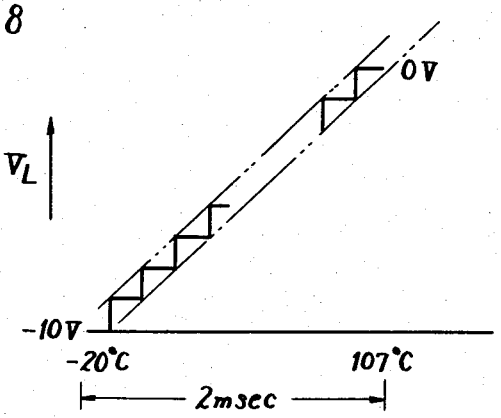
FIG. 8 is a graph showing a waveform of an example of an output voltage, i.e. a stepwise voltage signal obtained from a resistor ladder network.

The resistor ladder circuit 31 is well known to those skilled in the art and comprises an arrangement of the resistors of the resistance values R and 2R in a ladder configuration. The resistor ladder circuit 31 is supplied with the count signals SG0 to SG6 of seven bits through the impedance converting AND gates 310 to 316. Accordingly, the output terminal 317 of the resistor ladder circuit 31 provides a stepwise voltage VL as shown in FIG. 8. More specifically, the output becomes −10 V if and when the count signals SG0 to SG6 are all 0 (−10 V) and becomes 0 V if and when these are all 1 (0 V), while the output is increased step by step from −10 V as the count up proceeds in a binary fashion. Accordingly, the stepwise voltage VL assumes the values of 128 steps in total in accordance with the output states of the count signals SG0 to SG6. The output states of the count signals SG0 to SG6 corresponding to these 128 steps are processed by the microprocessor 100 by way of temperature information. More specifically, if and when the stepwise voltage VL is −10 V the corresponding output state (000 . . . 0) is processed as representing −20° C. and an increase of each step thereafter is processed as representing an increase of 1° C., until the stepwise voltage VL reaches 0 V, the corresponding output state (111 . . . 1) of which is processed as representing 107° C. Although the embodiment was described as employing a stepwise voltage changing stepwise in the direction toward a higher voltage, the embodiment may employ a stepwise voltage changing stepwise in the direction toward a lower voltage.

Figure 9:
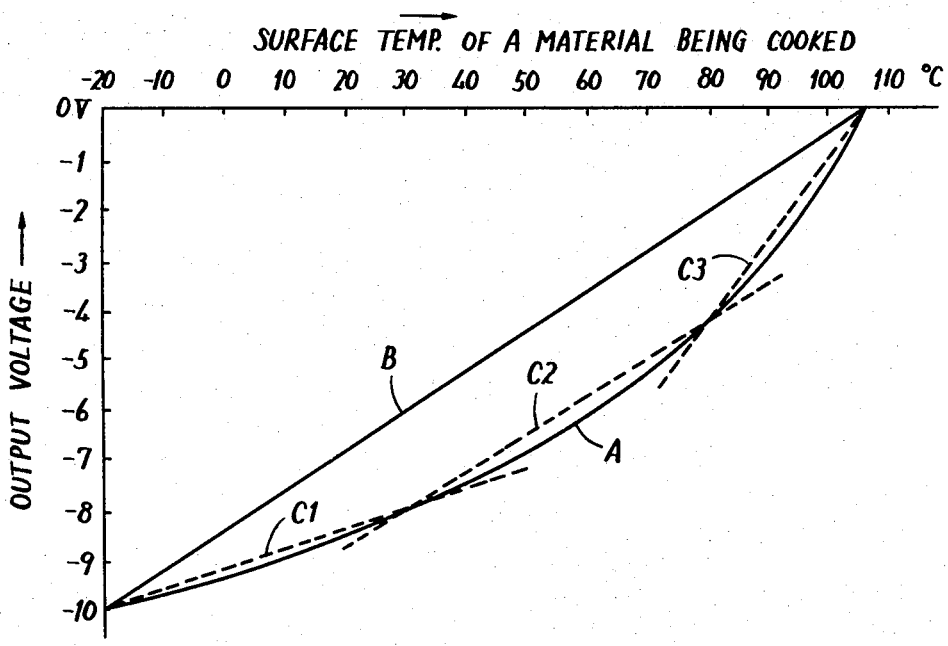
FIG. 9 is a graph showing a relation between the output voltage obtained from a temperature output circuit and a surface temperature of a material being cooked, wherein the ordinate indicates the output voltage and the abscissa indicates the surface temperature of a material being cooked.

The polygonal line analogous circuit 33 is aimed to make the above described stepwise voltage V0 of a substantially linear variation analogous to a predetermined curve by virtue of a polygonal line characteristic of the circuit 33. More specifically, the output of an infrared detecting device 405 (FIG. 7) to be described subsequently is properly processed for the purpose of a desired compensation and thereafter a temperature output MT is obtained from a temperature output circuit 35, which is compared with the above described stepwise voltage VL. On that occasion, a correlation between the value of the above described temperature output MT and the actual temperature of a material being cooked is not linear but rather somewhat curved as shown by the curve A in FIG. 9, which is theoretically a fourth power curve, in view of the fact that an infrared detecting device is used. Accordingly, even if the circuit constants of the temperature output circuit 35 are selected such that the output voltage on the occasion of −20° C. may be −10 V and the output voltage on the occasion of 107° C. may be 0 V, respectively, coincidence is not attained, except for the above described two points of −20° C. and 107° C., between the stepwise voltage VL which exhibits a linear characteristic B with respect to the temperature and the curve A, resulting in a comparison error therebetween. The polygonal line analogous circuit 33 is adapted to convert the stepwise voltage VL which is in a linear relation with respect to the temperature, i.e. the straight line B in FIG. 9 to three polygonal lines C1 (−10 V to −8 V), C2 (−8 V to −4 V) and C3 (−4 V to 0 V) to provide an output analogous to the curve A, for the purpose of minimizing the above comparison error.

Figure 10:
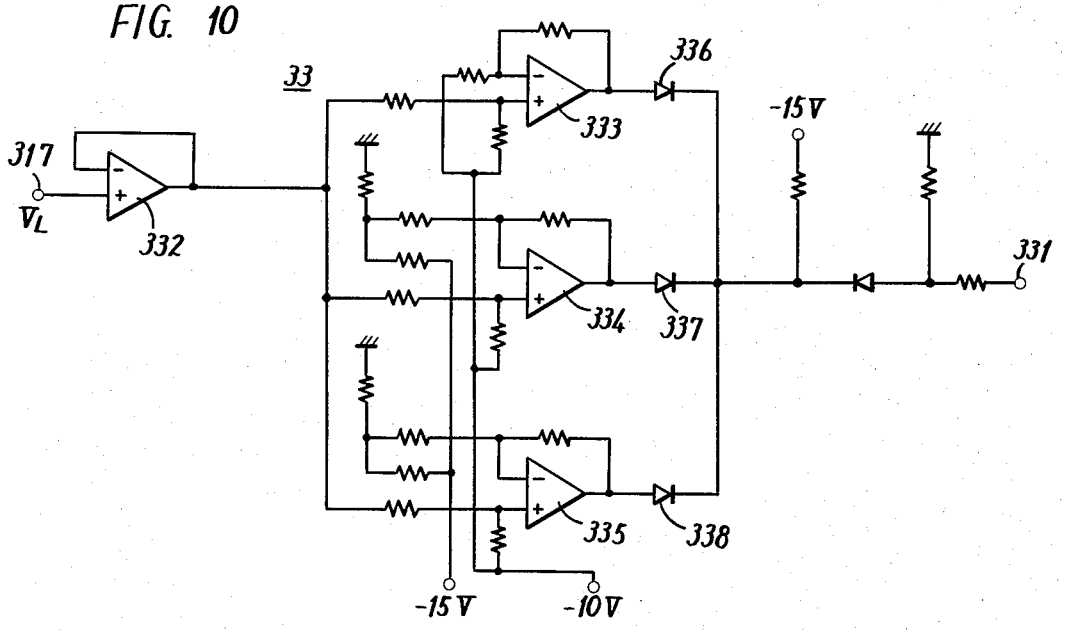
FIG. 10 is a schematic diagram of a preferred embodiment of a polygonal line analogous circuit.

FIG. 10 shows a schematic diagram of the polygonal line anagolous circuit 33. The above described stepwise voltage VL is applied through an impedance converting operational amplifier 332 to the circuit 33 and the inputted value is withdrawn through any one of first to third operational amplifiers 333 to 335 and from the output terminal 331 of the circuit 33.

The first operational amplifier 333 is level set such that the same becomes operable if and when the above described input value exceeds −10 V. Similarly, the second and third operational amplifiers 334 and 335 are level set such that the same become operable if and when the input value exceeds −8 V and −4 V, respectively. The respective operational amplifiers 333, 334 and 335 are adapted to be cooperative with feedback resistors associated with the respective amplifiers to exhibit the output characteristics in the respective operational ranges which are coincident with the respective polygonal lines C1, C2 and C3 shown in FIG. 9. Furthermore, these operational amplifiers provide −10 V in the respective nonoperational ranges, so that by virtue of an OR gate implemented by diodes 336, 337 and 338 the characteristic of the polygonal line C1 corresponding to the temperature range of −20° C. to 30° C. is achieved for the range of the input value, i.e. the stepwise voltage VL of −10 V to −8 V, the characteristic of the polygonal line C2 corresponding to the temperature range of 30° C. to 80° C. is achieved for the range of the stepwise voltage VL of −8 V to −4 V and the characteristic of the polygonal line C3 corresponding to the temperature range of 80° C. to 107° C. is achieved for the range of the stepwise voltage VL of −4 V to 0 V, all from the output terminal 33. As a result, the output characteristic of the circuit 33 is analogous to the curve A.

Figure 7:
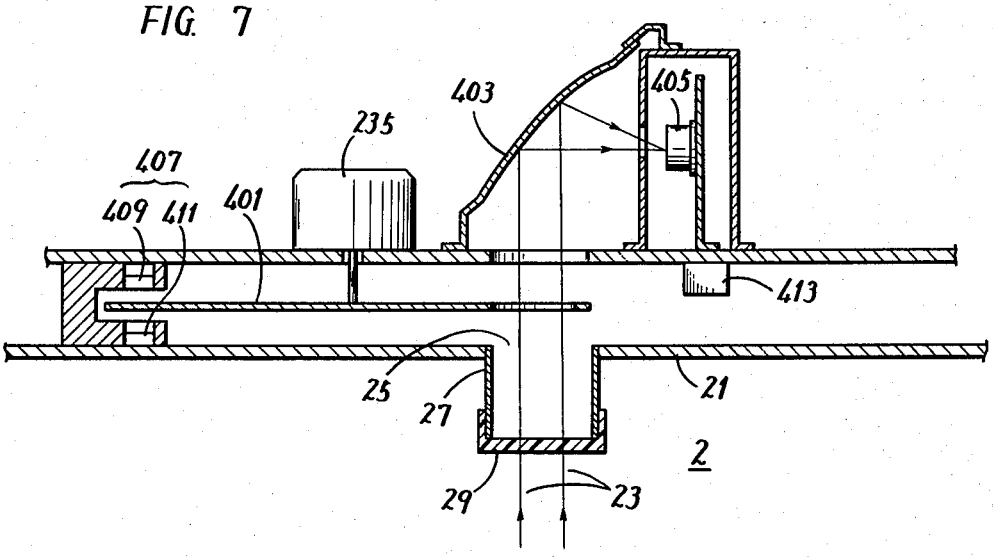
FIG. 7 is a sectional view showing an arrangement of an infrared detecting device used as an example of a temperature detecting means in the present invention.

FIG. 7 shows an arrangement of components for detecting an infrared disposed between an upper wall of a cooking chamber 2 and a cover cabinet of a microwave oven. An infrared radiation 23 emitted from a material being cooked placed in the cooking chamber 2 is transmitted through the central opening 25 of the upper wall 21 of the cooking chamber 2 outward of the cooking chamber and is chopped by a chopper 401. The infrared radiation as chopped by the chopper 401 is converged by a concave mirror 403 and reaches an infrared radiation detecting device 405.

A metallic cylinder 27 is mounted to the opening 25 of the upper wall of the cooking chamber and the end opening of the cylinder 27 is covered by an infrared radiation transmissible cover 29 made of polyethylene or the like. The metallic cylinder 27 is 20 mm in inner diameter and 12 mm in length, so that a microwave oven supplied to the cooking chamber 2 cannot pass through the cylinder 27.

The chopper 401 comprises an apertured disk rotatively driven by the synchronous motor 235, so that the incidental infrared radiation 23 is chopped at the frequency of 20 Hz. Such chop cycle is detected by a photointerrupter 407 including a light emitting device 409 and a photosensitive device 411 disposed to be faced to each other with the chopper 401 therebetween.

The infrared radiation detecting device 405 is made of lithium tantalate ($LiTaO_3$) crystal and such device per se is well known as a pyroelectric type infrared radiation detecting device. More specifically, assuming that the temperature of a material being cooked is T0 and the temperature of the chopper 401 per se is Tc, then the device 405 is subjected to an infrared radiation corresponding to the temperature T0 and an infrared radiation corresponding to the temperature Tc alternately at the cycle of 20 Hz, so that a device 405 provides a voltage corresponding to a difference between both temperatures T0 and Tc. The temperature of a material being cooked detected by the device 405 is thus different by the temperature of the chopper 401 and therefore a semiconductor diode 413 is provided in the vicinity of the chopper in order to compensate the same. Thus, a temperature approximating that of the chopper 401 per se is detected by the use of a temperature characteristic of the above described diode 413. Such compensation processing will be described subsequently.

Figure 11:
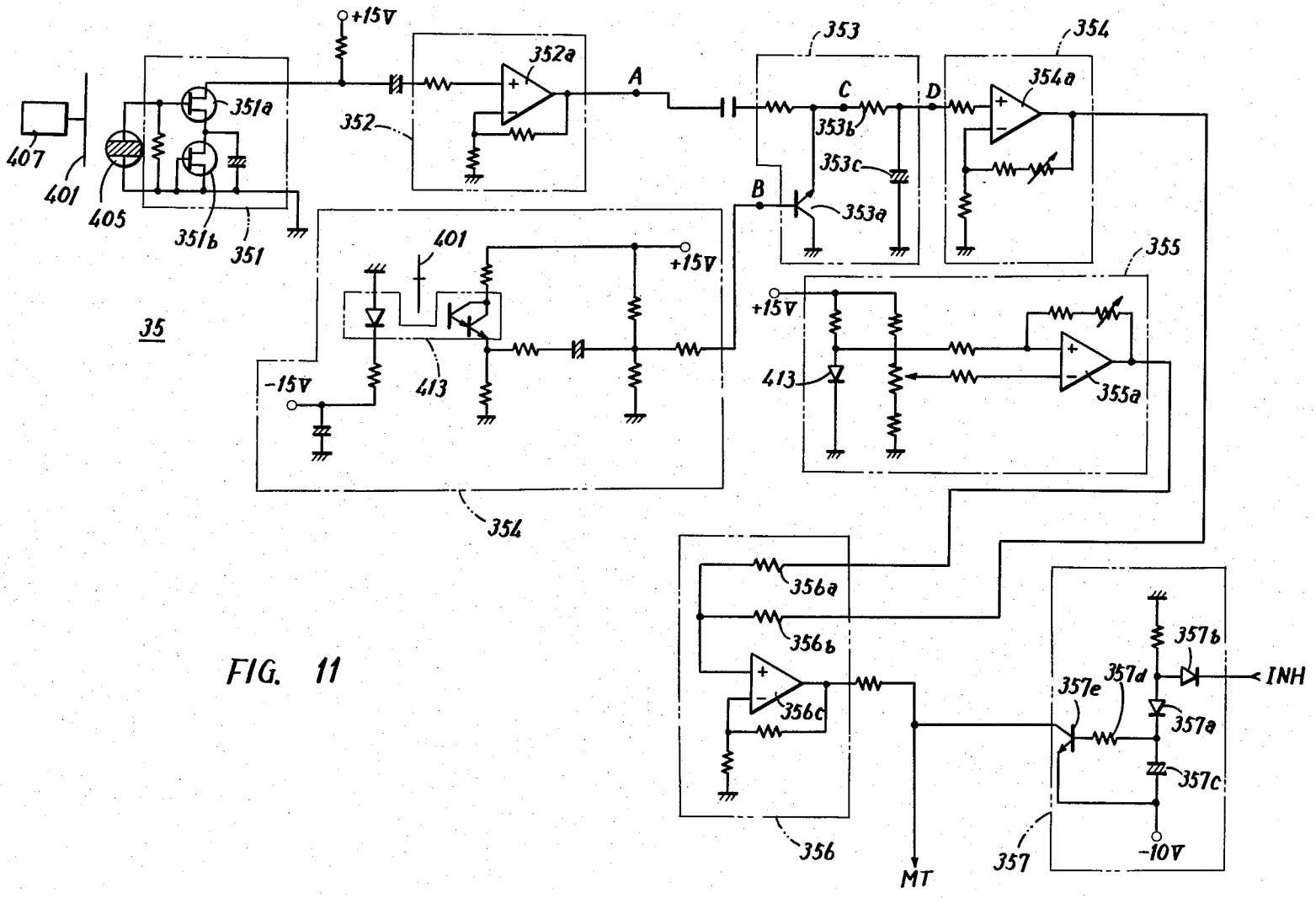
FIG. 11 is a schematic diagram of a preferred embodiment of a temperature output circuit.

FIG. 11 is a schematic diagram of the temperature output circuit 35. The infrared radiation received through the chopper 401 is converted into a voltage by means of an infrared radiation detecting device 405 and the converted output is amplified by a preamplifier 351 including field effect transistors 351*a* and 351*b* and a main amplifier 353 including an operational amplifier 352*a*. The waveform at the output point A of the main amplifier 352 is shown in FIG. 12A. Referring to FIG. 12A, the dotted line shows a case where the temperature T0 of a material being cooked is higher than the temperature Tc of the chopper 401 per se and the solid line shows a reversed case. These waveforms are substantially sine waveforms, as shown, and the frequency thereof is 20 Hz in association with the chopping speed by the chopper 401, so that the absolute value is proportional to $|T0-Tc|$, as described previously.

Figure 12:
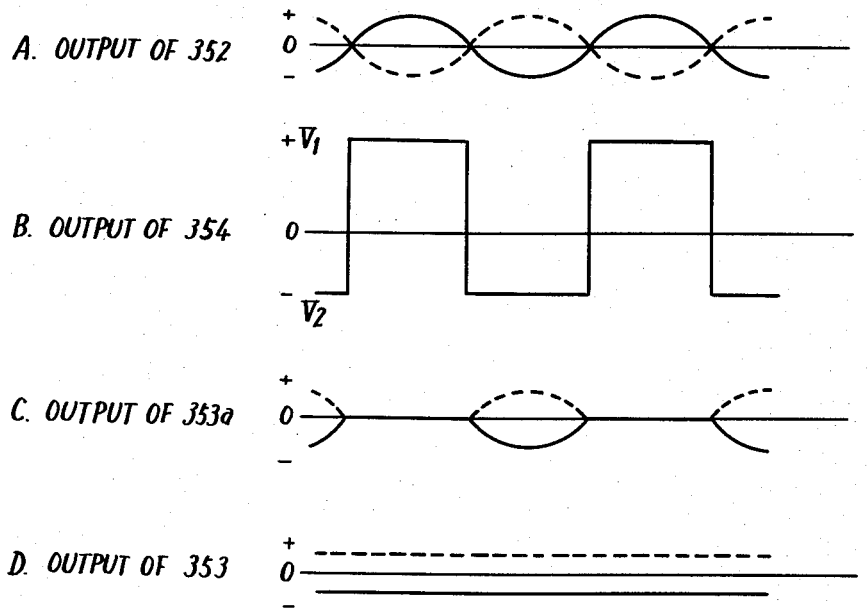
FIG. 12 is a graph showing waveforms of the electrical signals at various points in the FIG. 11 diagram.

The output of the main amplifier 352 is applied to a synchronous rectifying circuit 353, wherein the output is subjected to a switching operation by means of a switching transistor 353*a* and the output thereof is smoothed by a smoothing circuit including a resistor 353*b* and a capacitor 353*c*. The switching operation of the above described switching transistor 353*a* is controlled by the output of the synchronous detector 354. More specifically, the synchronous detector 354 comprises the above described photointerrupter 411 for detecting the cycle of the chopper 401. The output of the photointerrupter 411 and thus of the synchronous detector 354 is a rectangular alternating current voltage of 20 Hz changing between −V2 volt and +V1 volt as shown in FIG. 12B. The magnitudes of these voltages V1 and V2 are set to be larger than the maximum values which is expected of the output of the main amplifer 352. Therefore, the waveforms at the output point C of the switching transistor 353*a* and the output point D of the above described smoothing circuit are as shown as C and D in FIG. 12. Meanwhile, the absolute value of the waveform at the output point D is proportional to $|T0-Tc|$.

The output of the smoothing circuit is amplified by the amplifier 354 including the operational amplifer 354*a* and then is applied to an addition circuit 356. The addition circuit 356 is constituted by addition resistors 356*a* and 356*b* and an operational amplifer 356*c*. The other input to the addition circuit 356 is an output of a chopper temperature detecting circuit 355. More specifically, the chopper temperature detecting circuit 355 comprises the above described chopper temperature detecting diode 413 and an operational amplifer 355*a* and provides a direct current signal proportional to the temperature of the chopper 401 per se in accordance with the characteristic of the curve A shown in FIG. 9. Therefore, the temperature of the chopper 401 per se is removed from the addition circuit 356, so that the output voltage only associated with the temperature of a material being cooked is obtained. The output voltage is the very temperature output MT as compensated as described previously.

Although the above described temperature output MT is applied to the comparator 37 (FIG. 2), application of the input is prevented by means of an inhibiting circuit 357 for a predetermined time period at the beginning of the temperature running operation. More specifically, on the occasion of the non-temperature running operation, the capacitor 357 has been charged through the diode 357*a* in the prohibiting circuit 357. More specifically, the signal INH of −10 V is applied through the diode 357*b* from the transistor 38 (FIG. 2) simultaneously with the start of the temperature running operation and the above described charging path is interrupted, so that the transistor 357*e* is turned on during a period when the charge as charged in the capacitor 357*c* is discharged through the resistor 357*d* and the transistor 357*e* and thus the temperature output MT is formed to −10 V for that time period. The prohibiting time period is determined as a time period (several seconds) until the chopper 401 which starts rotating simultaneously with the start of the temperature running operation reaches a stabilized rotation state.

Thus, the comparator 37 is supplied with the outputs of the polygonal line analogous circuit 33 and the temperature output circuit 35, so that both outputs are compared to provide the signal MTE if and when the output value of the polygonal line analogous circuit 33 exceeds the output value of the temperature output circuit 35. The microprocessor 100 is adapted such that the state of the output signals SG0 to SG6 of seven bits is changed to those corresponding to 107° C. from those corresponding to −20° C. on the occasion of the first temperature measurement. However, the time period required for one cycle time from −20° C. to 107° C., i.e. the time period required for variation of the stepwise voltage VL from −10 V to 0 V is as extremely short as approximately 2 milli-seconds and accordingly the temperature of a material being cooked and thus the value of the temperature output MT is deemed as constant for that period. Therefore, now assuming that the temperature of a material being cooked is 90° C. and the temperature is measured at that time point, then the temperature output MT is approximately −2.5 V and accordingly the output MTE is obtained from the comparator 37 at the time point when the output of the polygonal line analogous circuit 33 reaches −2.5 V and the microprocessor 100 immediately fixes a state of the output signals SG0 to SG6 of the seven bits. More specifically, at that time the signals SG0 to SG6 become (0101101), which state is processed by the microprocessor 100 as temperature information representing 90° C.

Figures 13, 14A, 14B:
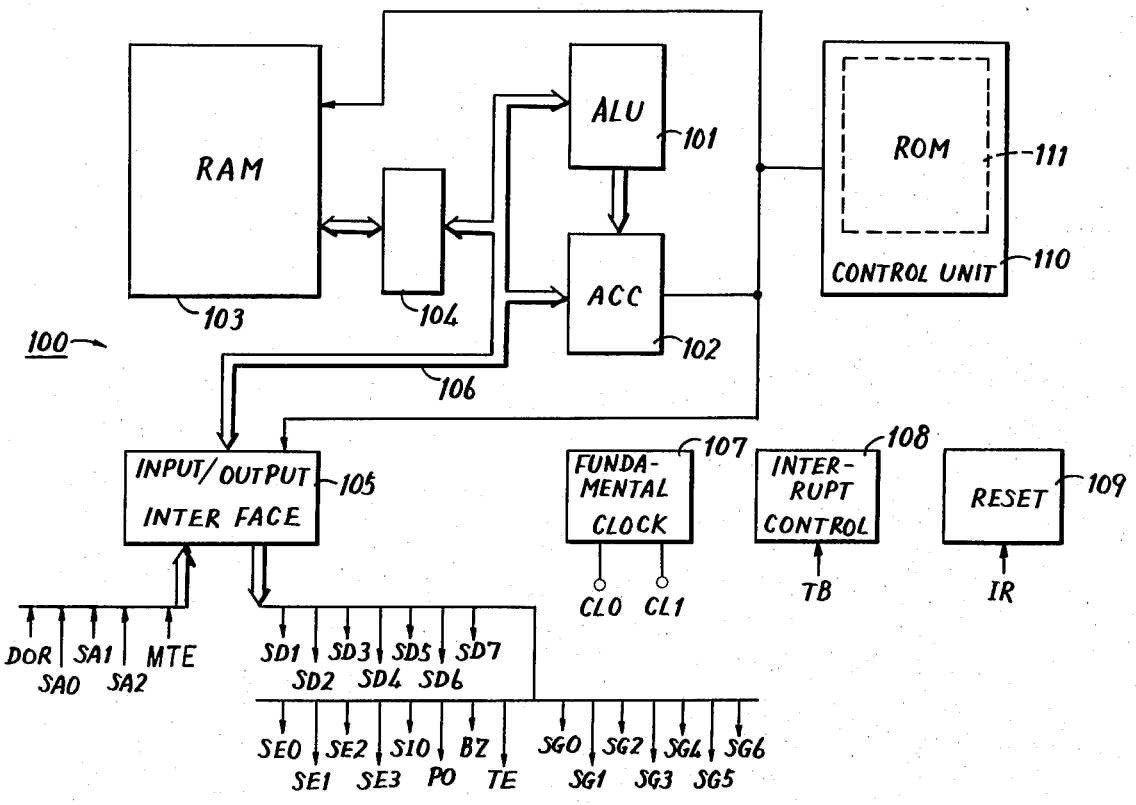
FIG. 13 is a block diagram of a microprocessor employed in the present invention.
FIGS. 14A and 14B diagrammatically show storing regions of a random access memory included in the microprocessor.

FIG. 13 shows a block diagram of the microprocessor 100, which comprises a control unit 110, an arithmetic unit 101, an accumulator 102, a random access memory 103, a random access memory buffer 104, an input/output interface 105 and the like, and a data bus 106 for communication of information between these blocks. The control unit 110 serves to control communication of the information within these blocks. The external input signals SA0, SA1, SA2, DOR, MTE and external output signals SD1 to SD7, SE0 to SE3, SI0, PO, TE and SG0~SG6 are inputted and outputted through the input/output interface 105.

The microprocessor 100 further comprises a reference clock signal generator 107, an interrupt control unit 108 and a reset unit 109. The reference clock signal generator 107 cooperates with an external component shown in FIG. 2 to generate a reference clock signal of 400 kHz and the interrupt control unit 108 is structured to be responsive to a time base signal TB to command an interrupt operation for a necessary timing operation. The reset unit 109 is structured to be responsive to the reset signal IR to command a necessary reset operation.

The control unit comprises a ready only memory 111 for storing a control program and various constants, a program counter, not shown, for performing the progress of steps of the above described control program, and a command decoder, not shown, for decoding various commands read at the respective steps for performing the tasks.

The random access memory 103 is used to store various kinds of data. FIG. 9A shows a diagram of storing areas of the random access memory 103. The storing areas of the random access memory 103 contain 0 to 3 pages, each page containing the addresses of sixteen digits 0 to 9 and A to F, so that any particular storing area can be accessed by addressing of these pages and digits. To that end, the random access memory 103 also comprises an address register. Each of the digits 0 to 9 and A to F of the random access memory 103 comprises a four-bit length. Each of the areas denoted as "DISPLAY", "TIMER", and "CLOCK" is of a four-digit length, so that a decimal number may be stored in one digit position as a binary coded decimal code. Each of the areas as denoted as "CNT1", "CNT2", "TEMPA" and "TEMPB" is of a two-digit length, so that a decimal number may be stored in one digit position as a binary coded decimal code. Each of the areas as denoted as "PWR A", "PWR B", "POWER", "PWR D", "RD", "CNT 3", and "NKB" is of a one-digit length so that a decimal number may be similarly stored as a binary coded decimal code. The area as denoted as "FKB" is of a one-digit length, so that information may be stored as a four-bit code. The area as denoted as "TCNT" is of a two-digit length and is used to store 8-bit data. Each of the areas as denoted as "KNF", "CTL" and "RF" is of a one-digit length, and the bit structure thereof is shown in FIG. 9B. The control unit 110 serves to perform a control operation as a function of the data stored in the random access memory 103 and a program prepared and stored for that purpose in the read only memory 111 is shown in FIGS. 15A to 15L.

Referring to FIGS. 15A to 15L, various functions of a microwave oven in accordance with one embodiment of the present invention will be described. It is pointed out that in the following description each address of the random access memory 103 is denoted as [page, digit] for simplicity and accordingly, [2,3] represents the address of page 2, digit 3, for example. Similarly, the microprocessor 100, the read only memory 111 and the random access memory 103 are simply referred to as the microprocessor, the read only memory, and the random access memory, respectively, for simplicity of description in the following.

START OF ENERGIZATION

Figure 15A:
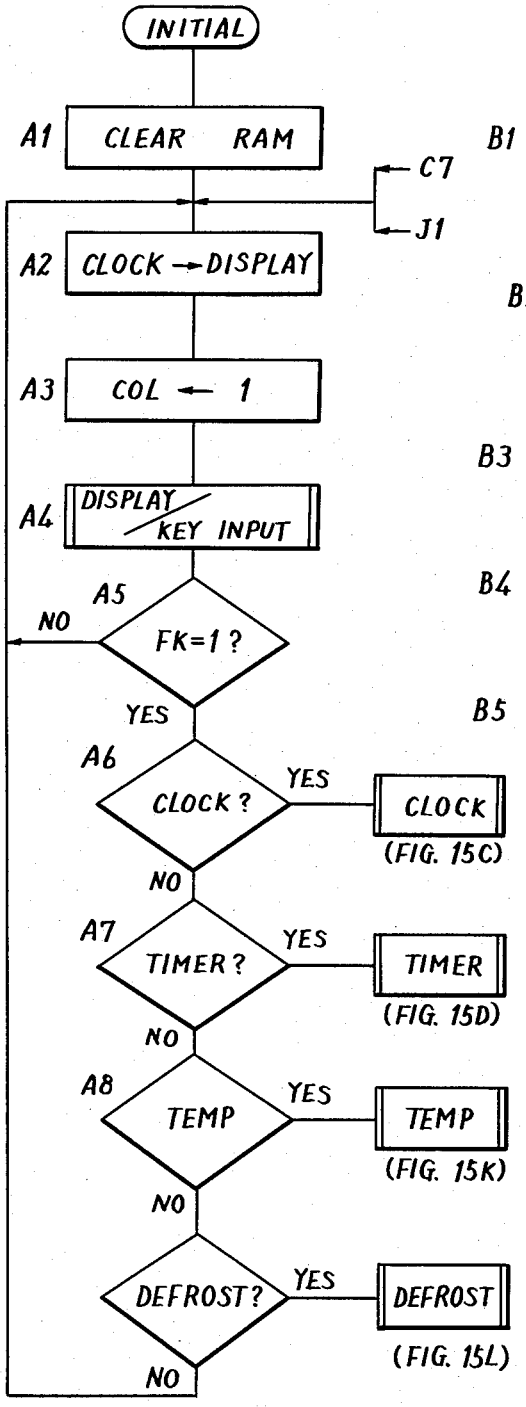
FIGS. 15A to 15L are flow diagrams showing an example of a program of the microprocessor.

At the beginning of energization of the microwave oven, an initial condition setting signal IR described with reference to FIG. 2 is applied to the microprocessor, so that the microprocessor is automatically brought to the step A1 of an initial routine (FIG. 15A).

At the step A1 the logic zero is loaded in all the storing areas of the random access memory, thereby to clear all the contents in the random access memory. Then the routine sequentially proceeds to the steps A2 and A3. At the step A2 the data in the area "CLOCK" of the random access memory is transferred to the area "DISPLAY" in preparation for display of the current time. At the step A3 the logic one is loaded in the area "COL" in preparation for display of the current time.

The program then proceeds to the step A4, wherein the microprocessor sequentially generates the control signals SE0 to SE3 and SI0, whereby processing of display, key detection and colon reset are performed.

On the occasion of the above described display processing the data in the respective addresses of the first to fourth digits in the area "DISPLAY" of the random access memory i.e. [0,3], [0,2] [0,1] and [0,0] of the random access memory, is sequentially read out in synchronism with generation of the control signals SE0 to SE3, whereupon these are converted into a seven-bit code signal and is withdrawn as the display data signals SD1 to SD7. Meanwhile, at that time undesired zeros at the more significant positions are prevented from being displayed by way of the so called zero suppressing, so that only the effective numerals are displayed. In the case where the redundant code (1111) have been loaded in arbitrary digits in the region DISPLAY, a display data signal SD7 is obtained and the same brings about a minus sign indication at the digit position one digit more significant than the most significant digit of the effective numerals, as shown in FIG. 3B. Furthermore, in the case where the redundant code (0111) has been loaded in the arbitrary digits in the region DISPLAY, the display data signals SD1, SD2, SD3 and SD7 are generated, which brings about display of the letter F as shown in FIG. 3E. On the occasion of generation of the control signal SI0 the data in the areas "COL" of the random access memory is evaluated and, if and when the same is the logic one, the display data signal SD6 is generated.

Accordingly, at the step A4 the data in the area "DISPLAY" of the random access memory is displayed in a time sharing fashion by means of the display portion 5. In case of the operation now in discussion the data in the area "DISPLAY" becomes the data in the area "CLOCK" and the colon mark is displayed, so that the current time is displayed; however, at the beginning of energization, since the data in the area "CLOCK" has been cleared, the display portion 5 makes display as "0.00".

On the other hand, since the control signals SE0, SE2, and SI0 at the above described step A4 have been applied to the key matrix 60, an operation of any keys at that time by means of the operating portion 6 causes the corresponding input data signals SA0, SA1 and SA2 to be entered into the microprocessor.

Such input data signal is determined by the microprocessor, so that if and when the input data signal is of the numeral keys the logic one is loaded in the area "NK" of the random access memory and the input data signal of three bits is converted into a binary coded decimal code in accordance with the conversion table shown in FIG. 6B and the converted code is loaded in the area "NKB", whereas if and when the input data signal is of the function keys the logic one is loaded in the area "FK" of the random access memory and the input data signal is similarly converted into a four-bit code in accordance with the conversion table shown in FIG. 6B, which converted code is loaded in the area "FKB" of the random access memory.

As better understood from the subsequent description, the step A4 constitutes one step constituting a recirculation loop of the program, while a key operation is manually performed, and therefore the operation time period is sufficiently long as compared with the step progressing time period of the program, which means that the program is executed such that the step A4 is performed several times during manual operation of a key. However, upon operation of a key, the microprocessor loads the logic one in the area "KE" of the random access memory at the first performance for determination of the input data signal, whereby the second and further performance of the step is descriminated from the first performance of the step A4. More specifically, the microprocessor determines the data in the area "KE" in the step A4, such that if and when the same is the logic one, then in spite of a key operated state, determination is made that such key operation is the same as the key operation determined at the first performance of the step A4, whereupon the logic zero is loaded in the area "FK" and the area "NK" of the random access memory. If and when no key is operated at the step A4, then the logic zero has been loaded in the respective areas "FK", "NK" and "KE" of the random access memory. At the step A4, the logic zero is further loaded in the area "COL" of the random access memory after a period of generation of the above described control signal SI0, whereupon the colon reset processing is performed. After the step A4, the program proceeds to the step A5.

At the step A5, the kind of the key operated at the step A4 is determined as to whether or not the operated key is a function key. More specifically, the data in the area "FK" in the random access memory is determined and if and when the same is determined as the logic zero the program is caused to proceed to the step A2, whereas if and when the same is determined as the logic one the program is caused to proceed to the step A6. In the operation now in discussion, it has been assumed that no key is depressed at the step A4 and accordingly the program is caused to return to the step A2. Thereafter, unless a function key is operated, the program is caused to circulate the steps A2, A3, A4 and A5.

TIMING PROCESSING

Figure 15B:
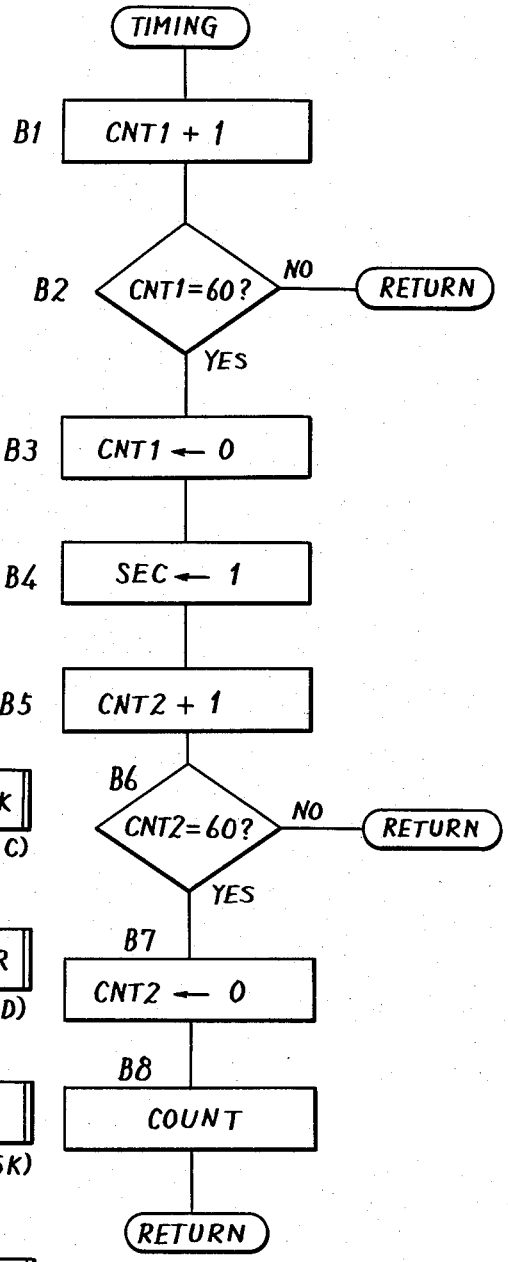
Figure 15D:
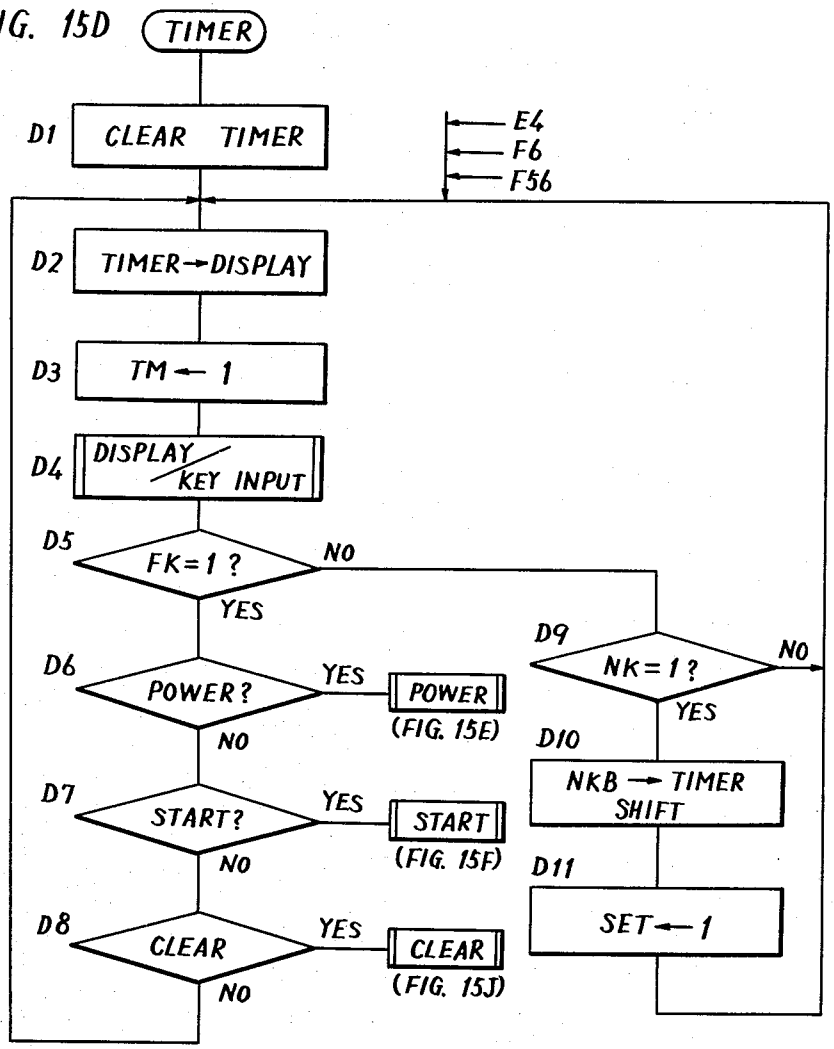

Upon application of the time base signal TB to the terminal $\overline{\text{INT}}$, the microprocessor interrupts all the processing at that time point and instead performs a timing processing operation by a timing routine shown in FIG. 15B, whereupon the program again returns to the step on the occasion of the above described interruption.

The timing routine is aimed to renew the current time of the area "CLOCK" of the random access memory by generating a second signal and a minute signal through a counting operation of the number of the time base signal TB of 60 Hz as received and by utilizing such minute signal. At the first step B1 of the timing routine, "1" is added to the data in the area "CNT1" of the random access memory, whereupon the data in the area "CNT1" is determined at the following step B2. Unless the data in the area "CNT1" is determined as equal to "60", the program is caused to return to the step on the occasion of the above described interruption, whereas if and when the data in the area "CNT1" is determined as equal to "60" the program is caused to proceed to the step B3. Thus, a shift to the step B3 means the lapse of one second.

At the step B3 "0" is loaded in the area "CNT1" and at the following step B4 the logic one is loaded in the area "SEC" of the random access memory, whereby the lapse of one second is stored, whereupon the program shifts to the following step B5.

At the step B5 "1" is added to the data in the area "CNT2" of the random access memory and at the following step B6 the data in the area "CNT2" is determined. Unless the data in the area "CNT2" is determined as equal to "60", the program is caused to return to the step on the occasion of the above described interruption, whereas if the data in the area "CNT2" is determined as equal to "60" the program is caused to proceed to the step B7. A shift of the program to the step B7 means the lapse of one minute.

At the step B7 "0" is loaded in the area "CNT2" and at the following step B8 "1" is added to the data in the area "CLOCK" of the random access memory. At that time, a carry from the first digit [0,3] to the second digit [0,2] in the area "CLOCK" is made in a decimal fashion, a carry from the second digit to the third digit [0,1] is performed in a sixnary fashion, and a carry from the third digit to the fourth digit [0,0] is performed in the decimal fashion, respectively. If and when the following "1" is added in such a situation where the data in the area "CLOCK" is 59 minutes past 12 o'clock, the data in the area "CLOCK" returns to a state of indication of zero minute past one o'clock. The program then returns to the step on the occasion of the above described interruption.

Thus it would be appreciated that in accordance with the timing routine a timing operation is performed based on the time base signal TB, so that the data in the area "CLOCK" of the random access memory is renewed to the current time.

As is clear from the foregoing description of START OF ENERGIZATION and TIMING PROCESSING, upon energization of the inventive microwave oven, all the areas of the random access memory are first cleared whereupon a timing operation is performed using the area "CLOCK" of the random access memory, while the data of the area is displayed by the display portion 5. In the above described case, no initial setting of the data in the area "CLOCK" has been made and therefore a time period that lapsed from the above described energization is displayed by the display portion 5.

TIME SETTING

In order to effect time setting of a time display by the display portion 5, the CLOCK key of the operating portion 6 is used. Assuming that the time is to be set to just two o'clock, the keys are operated in the following sequence.

[CLOCK] [2] [0] [0] [CLOCK]

In the following the progress of the program in accordance with the above described key operation sequence will be described.

Figure 15C:
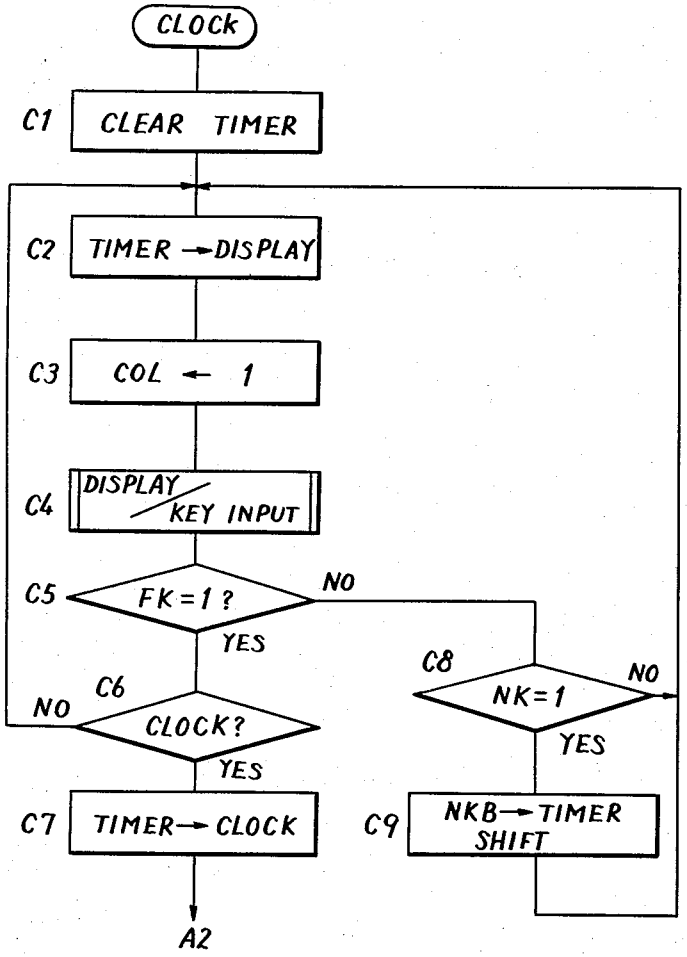
Figures 15E, 15G:
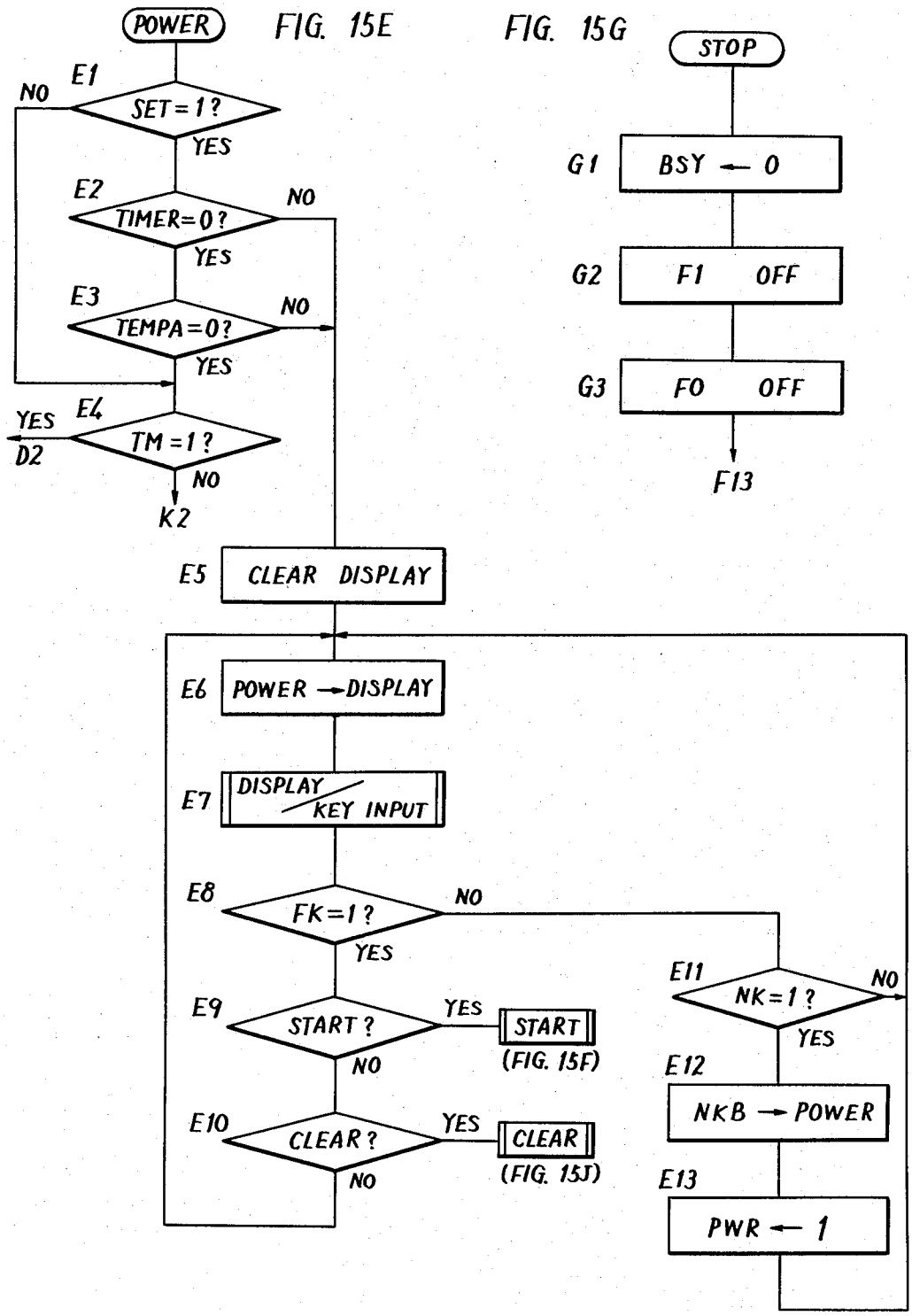

As described previously, the program is circulating the steps A2 to A5 of the initial routine. Accordingly, upon operation of the CLOCK key, the key operation is determined by the step A5, so that the program proceeds to the step A6. At the step A6, the data in the area "FKD" of the random access memory is determined as to whether the above described operated key is the CLOCK key. Since in the above described instance the depressed key is the CLOCK key, the program shifts to the clock routine (FIG. 15C).

At the first step C1 of the clock routine, "0" is loaded in all of the area "TIMER" of the random access memory, whereby the data therein is cleared, whereupon the program sequentially proceeds to the steps C2 and C3. At the step C2 the data in the area "TIMER" is transferred to the area "DISPLAY" and at the step C3 the logic one is loaded in the area "COL" in preparation for display of the current time.

The program then shifts to the step C4, wherein exactly the same processing as that of the step A4 of the initial routine is performed, whereupon the program shifts to the step C5.

At the step C5 the data in the area "FK" of the random access memory is determined. If the same is determined as the logic zero the program shifts to the step C8, whereas if the same is determined as the logic one the program shifts to the step C6. Since a key operation time period by the operating portion 6 is sufficiently long as compared with the progress of the steps of the program by means of the microprocessor, the key operated state has been stored in the area "KE" of the random access memory at the beginning when the clock routine is initiated responsive to the operation of the above described CLOCK key, so that on the occasion of departure from the step C4 the data in the area "FK" and the area "NK" remains the logic zero. Accordingly, the program shifts to the step C8. At the step C8 the data in the area "NK" of the random access memory is determined. If the same is determined as the logic zero the program shifts to the step C2, whereas if the same is determined as the logic one the program shifts to the step C9.

Since the data in the area "NK" of the random access memory is the logic zero at the moment, the program thereafter makes recirculation of the steps C2 to C5 and C8. If and when the above described CLOCK key is released from being depressed in the course of the above described recirculation, the data in the area "KE" becomes the logic zero and it follows that further key operation is determined by the step C4.

If and when further key operation is of the numeral key "2", then such key operation is determined at the above described step C4, whereby the program proceeds to the steps C5, C8 and C9. At the step C9 the data in the respective digit positions in the area "TIMER" of the random access memory is shifted by one digit toward the more significant digit, while the data in the area "NKB" of the random access memory is loaded in the first digit portion [1,3] of the area "TMMER", whereupon the program shifts to the step C2.

Accordingly, until further key operation, the program makes recirculation of the respective steps C2, C3, C4, C5 and C8, while the data in the area "TIMER" is displayed in the course of the above described recirculation. More specifically, the data "0:02" is displayed at that time.

Similarly thereafter, if and when key operation is made such that the numeral keys "0", "0", a display state "2:00" representing two hours zero minute by way of a set time period is displayed by the display portion 5, whereupon the program makes recirculation of the respective steps C2, C3, C4, C5 and C8.

Finally, when the CLOCK key is again operated, such key operation is determined by the step C4, so that the program shifts through the steps C5 to the step C6. At the step C6 it is determined whether the currently operated key is the CLOCK key by determining the data in the area "NKB" of the random access memory. If the key operation is determined as the CLOCK key, then the program proceeds to the step C2, and otherwise the program shifts to the step C7.

At the step C7, the data in the area "TIMER" of the random access memory is transferred to the area "CLOCK", whereupon the program thereafter makes recirculation of the respective steps A2 to A5 of the initial routine.

Accordingly, if and when the above described second operation of the CLOCK key is operated just at the time point of zero minute to or past two o'clock, the data in the area "CLOCK" of the random access memory is renewed with the lapse of time starting from zero minute to or past two o'clock, whereby a correct current time is displayed by the display portion 5, as shown in FIG. 3A.

TIMER OPERATION

Assuming that the microwave oven is operated at the 50% output value of the maximum microwave output for ten minutes, then key operation is made in the following order by means of the operating portion 6.

[TIMER] [1] [0] [0] [0] [POWER] [5] [START]

In the following the progress of the program in accordance with the above described key operation sequence will be described.

The program has been making recirculation of the respective steps A2 to A5 of the initial routine, as described previously. Accordingly, when the TIMER key is operated, such key operation is determined at the step A4, whereupon the program shifts through the steps A5 and A6 to the step A7. At the step A7 the data in the area "FKB" of the random access memory is determined, whereby it is determined whether the above described key operation is of the TIMER key. Since the key operation is of the TIMER key at that time, the program shifts to the timer routine (see FIG. 15D).

At the first step D1 of the timer routine, "0" is loaded in all the area "TIMER" of the random access memory, whereby the area is cleared, whereupon the program sequentially shifts to the steps D2 and D3. At the step D2, the data in the area TIMER of the random access memory is transferred to the area "DISPLAY", at the step D3 the logic one is written in the area "TM" of the random access memory, whereby at the step D4 exactly the same processing as that of the step A4 of the initial routine is performed, whereupon the program shifts to the step D5.

At the step D5, the data in the area "FK" of the random access memory is determined and, if the same is the logic zero, the program shifts to the step D9, whereas if the same is determined as the logic one, the program shifts to the step D6. At the step D9, the data in the area "NK" of the random access memory is determined and, if the same is determined as the logic zero, the program shifts to the step D2, whereas if the same is determined as the logic one, the program shifts to the step D10.

On leaving the above described step D4, the data in the respective areas "FK" and "NK" of the random access memory is the logic zero, unless further key operation is made, and therefore the program makes recirculation of the respective steps D2, D3, D4 and D9, so that "0" is displayed by the display portion 5.

If and when further key operation is made of the numeral key "1", such key operation is determined by the above described step D4 and the program returns to the step D2 through the respective steps D5, D9, D10 and D11. At the step D10 the data in the respective digit positions of the area "TIMER" of the random access memory is shifted by one digit toward the more significant digit, while the data in the area "NKB" of the random access memory is loaded in the first digit position [1,3] of the area "TIMER". At the step D11 the logic one is loaded in the area "SET" of the random access memory, whereby it is stored that the timer numerical value of at least one digit is entered.

Thereafter the program makes again recirculation of the respective steps D2, D3, D4, D5 and D9 until further key operation, while the data in the area "TIMER" is displayed in the course of the above described recirculation.

Similarly thereafter, upon further key operation of the numeral keys like "0", "0", "0", an indication "1000" representing ten minutes of a timer set time is displayed by the display portion 5 as shown in FIG. 3B, whereupon the program makes recirculation of the respective steps D2, D3, D4, D5 and D8.

Thereafter, upon further key operation which is of a function key, the program returns to the step D2 through the respective steps D6, D7 and D8. At the respective steps D6, D7 and D8, the data in the area "FKB" of the random access memory is determined to see whether the same is of the POWER key, the START key or the CLEAR key, and if the same is of any of them, immediately the program returns to the power routine (FIG. 15E), the start routine (FIG. 15F), or the clear routine (FIG. 15J), respectively.

Since new key operation at that time is of the POWER key, the program shifts to the power routine. At the first step E1 of the power routine, the content in the region SET of the random access memory is determined and if and when the same is the logic one the routine proceeds to the step E2 and if and when the same is the logic zero the routine proceeds to the step E4. At the step E2, the content in the region TIMER of the random access memory is determined and if the same is the logic zero the routine proceeds to the step E3 and if and when the same is not the logic zero the routine proceeds to the step E5. At the step E3 the content in the region TEMP A of the random access memory is determined and if and when the same is the logic zero the routine proceeds to the step E4 and if and when the same is not the logic zero the routine proceeds to the step E5.

Figures 1, 15F:
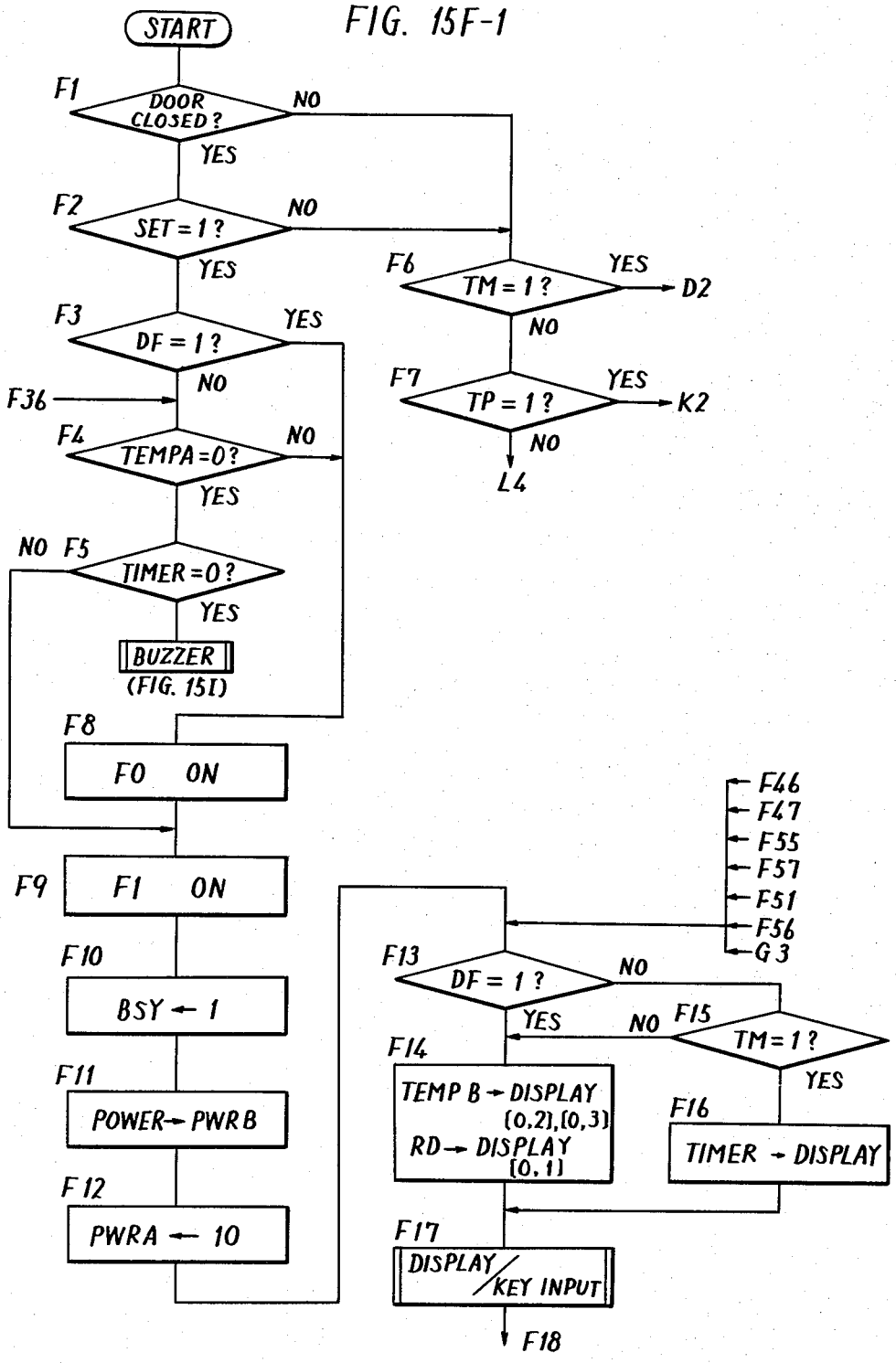
Figures 2, 15F:
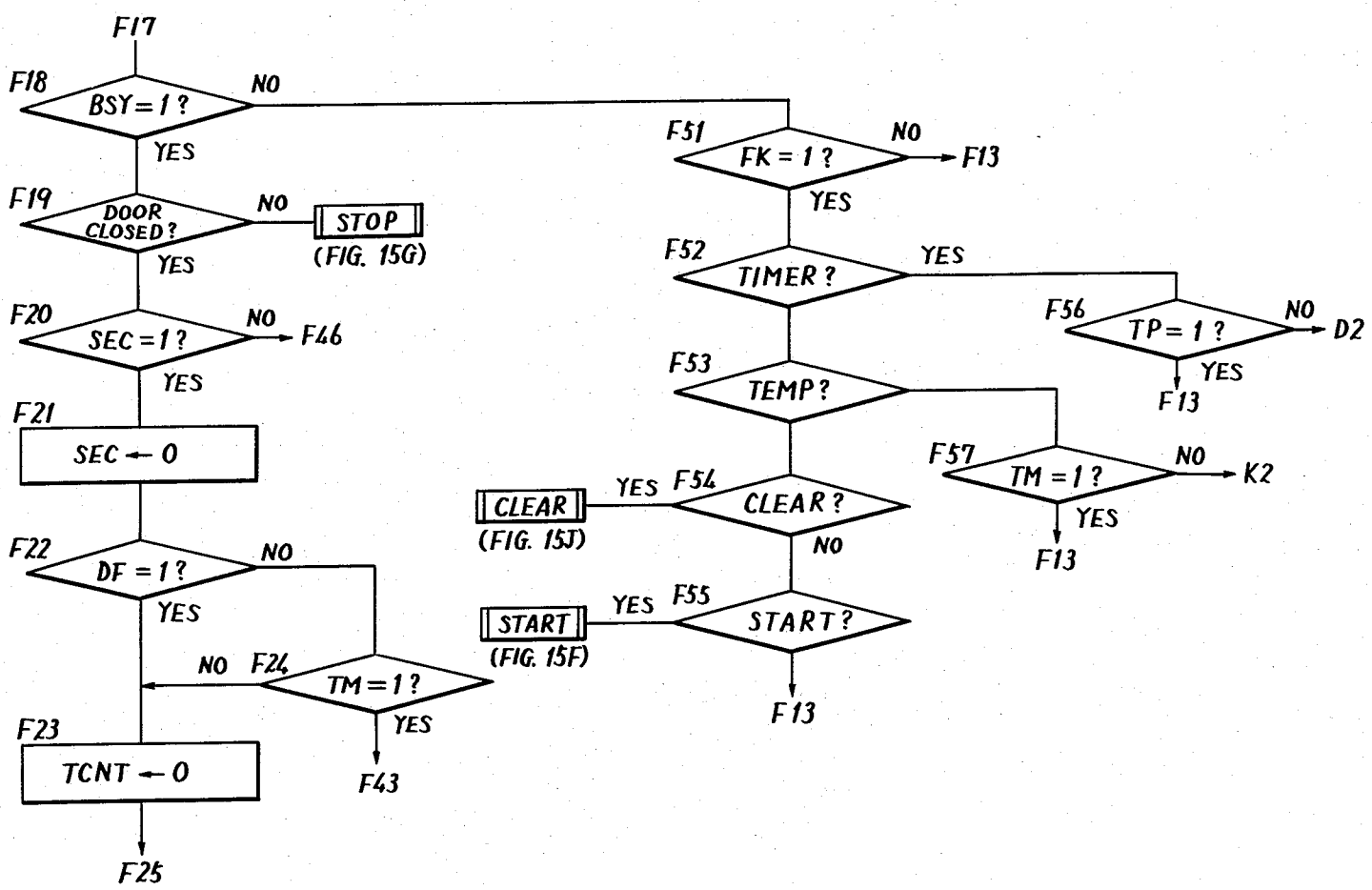
Figures 3, 15F:
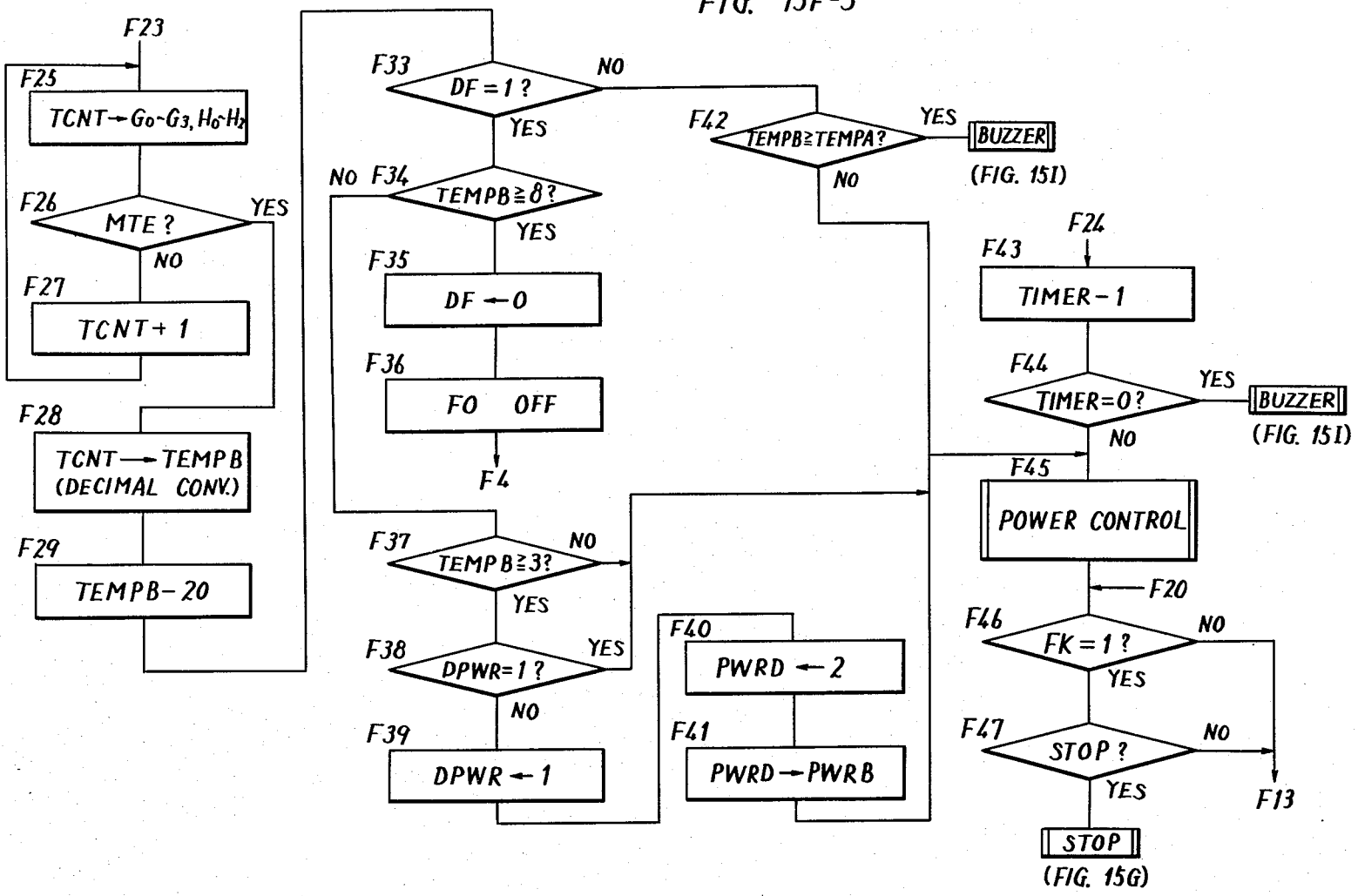
Figure 15H:
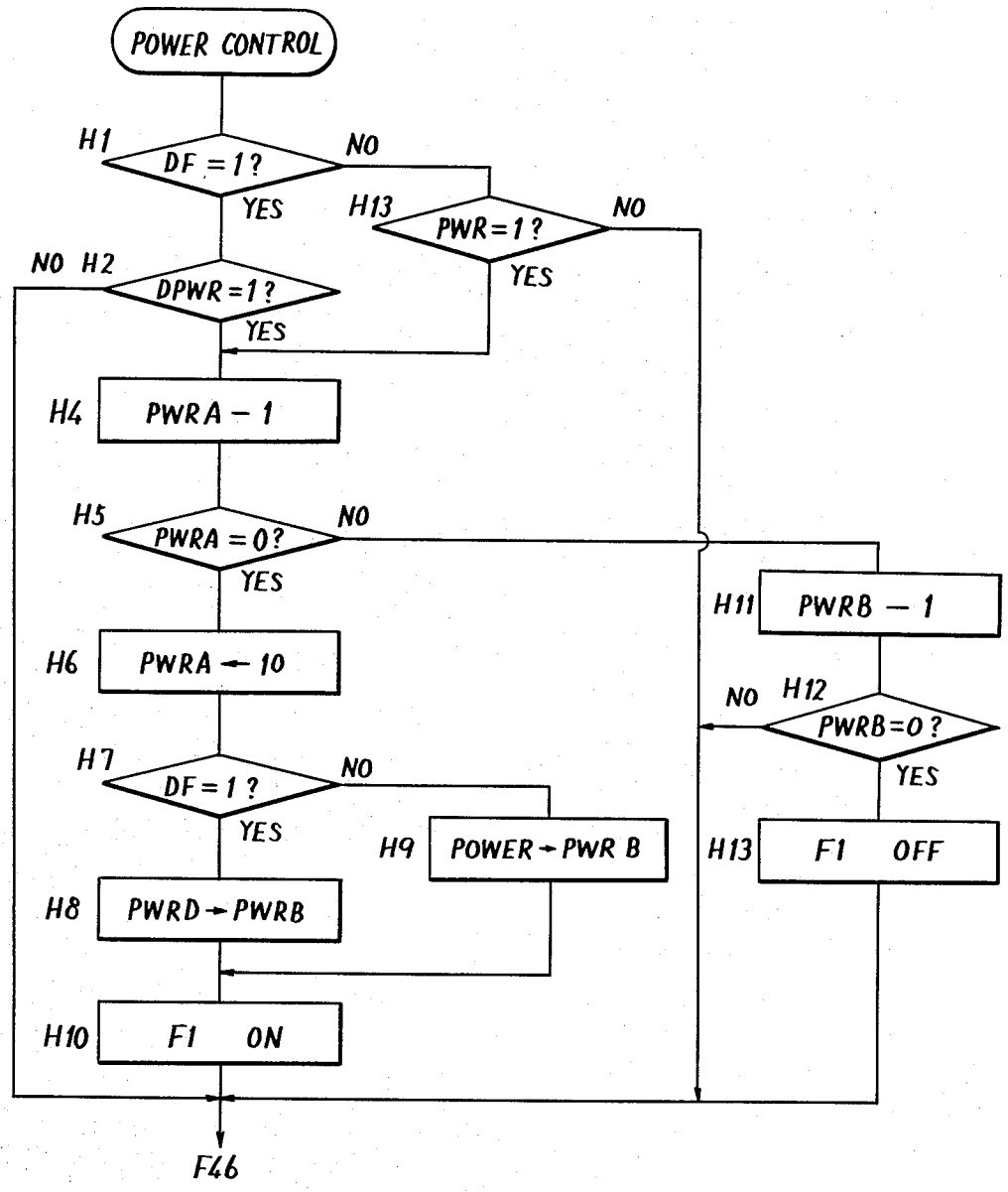
Figures 15I, 15J:
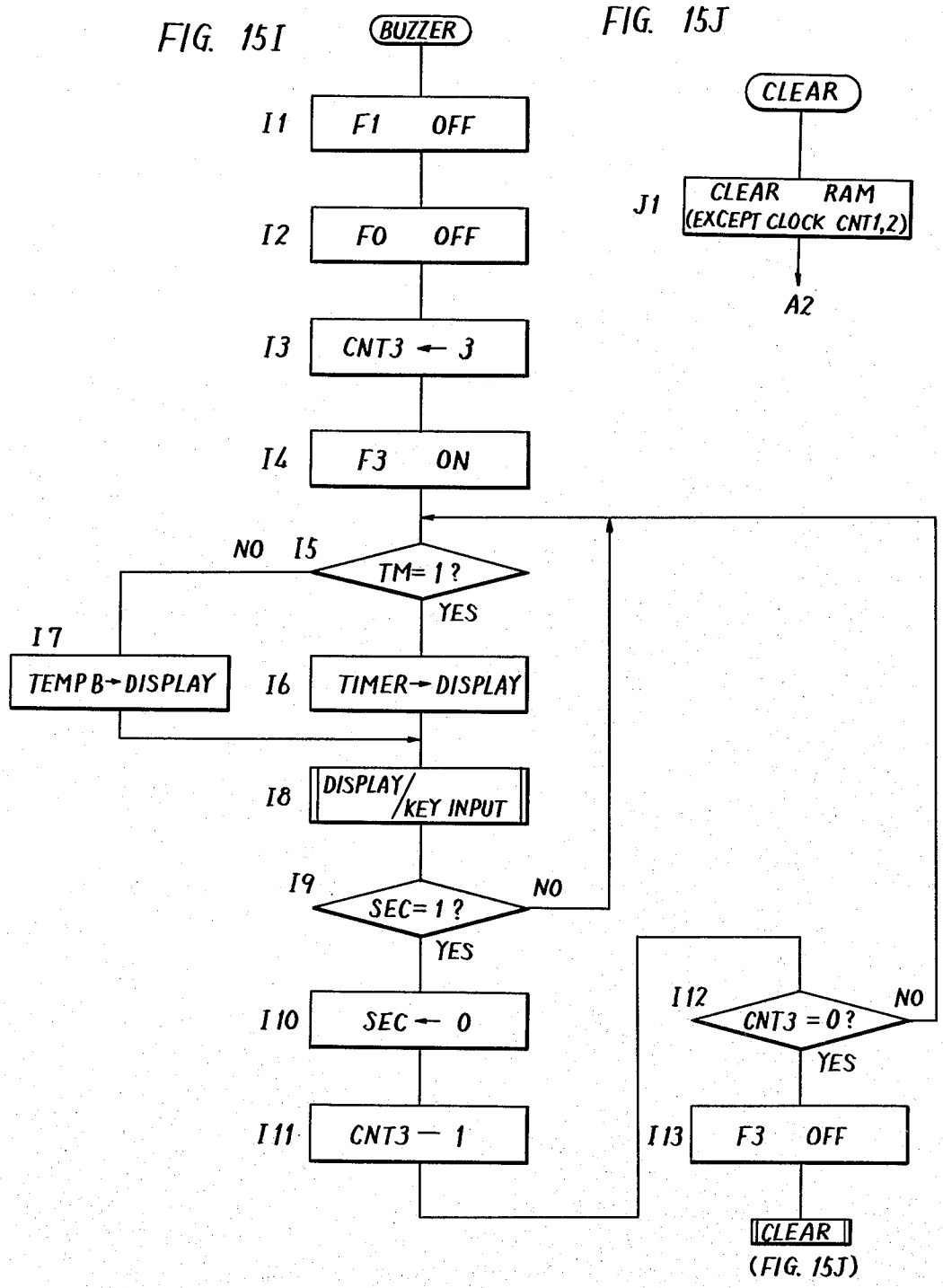
Figure 15K:
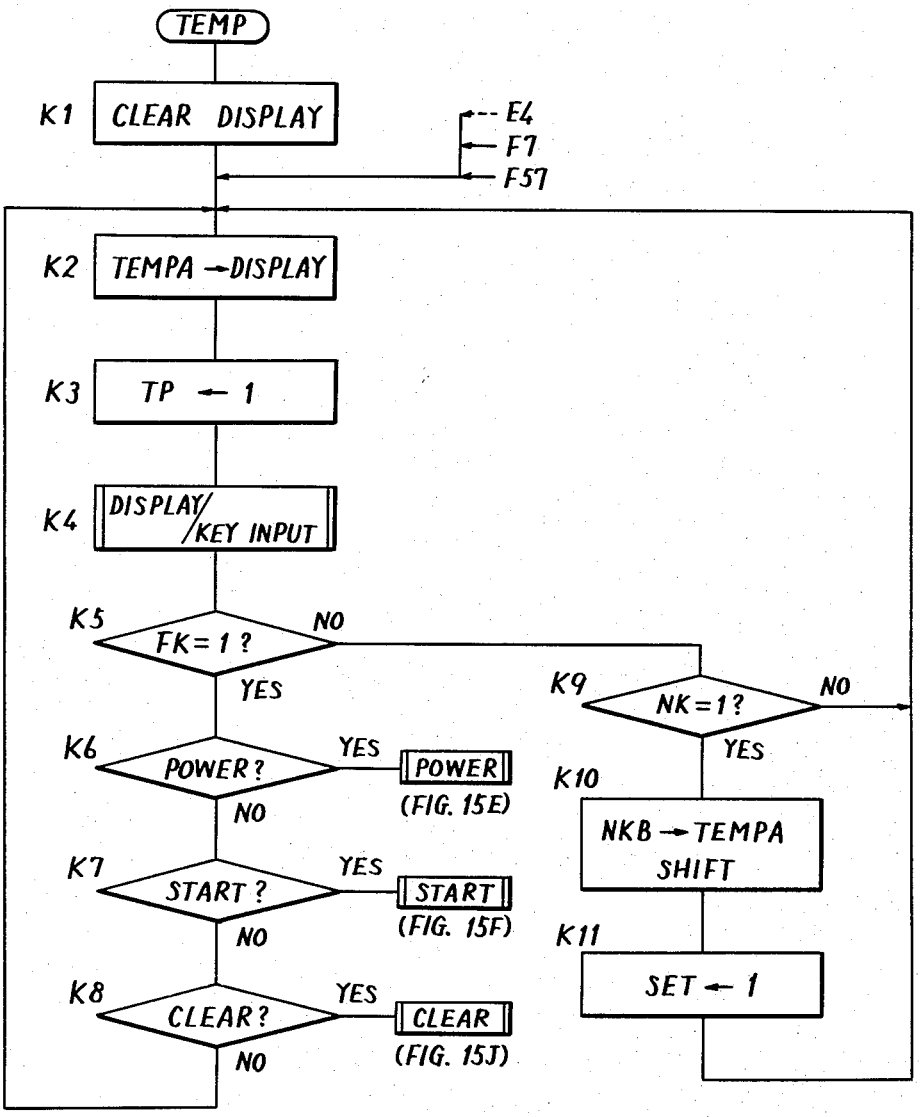

At the step E4 the content in the region TE of the random access memory is determined and if and when the same is the logic one the routine shifts to the step D2 of the timer routine (FIG. 15D) and if and when the same is the logic zero the routine shifts to the step K2 of the temperature routine (FIG. 15K).

Since now the content in the region STE is the logic one and the content in the region TIMER is that representing ten minutes and is not the logic zero, the program shifts to the step E5. At the step E5 of the power routine the logic zero is loaded in the area "DISPLAY" of the random access memory, whereby the data therein is cleared, whereupon the program shifts in succession to the respective steps E6 and E7. At the step E6, the data in the area "POWER" is transferred to the first digit position [0,3] of the area "DISPLAY". At the step E7, exactly the same processing as that of the step A4 of the initial routine is performed, whereupon the program shifts to the step E8.

At the step E8 the data in the area "FK" of the random access memory is determined and if the same is determined as the logic zero the program shifts to the step E11, whereas if the same is determined as the logic one the program shifts to the step E9. Furthermore, at the step E11 the data in the area "NK" of the random access memory is determined and if the same is determined as the logic zero the program shifts to the step E6, whereas if the same is determined as the logic one the program shifts to the step E12.

Since upon leaving the above described step E7 the data in the respective areas "FK" and "NK" of the random access memory is the logic zero unless further key operation is made, the program makes recirculation of the respective steps E6, E7, E8 and E11, whereby the data "0" is displayed by the display portion 5.

Now assuming that further key operation is made of the numeral key "5", such key operation is determined by the above described step E7 and the program returns to the step E6 through the respective steps E8, E11, E12 and E13. At the step E12 the data in the area "NKB" of the random access memory is loaded in the area "POWER" of the random access memory. At the step E13 the logic one is loaded in the area "PWR" of the random access memory, whereby the fact that the output value is set is stored.

Thereafter the program makes again recirculation of the respective steps E6, E7, E8 and E11 until further key operation is made, while the data in the area "POWER" is displayed during the above described recirculation. More specifically, an indication "5" representing the 50% output value is displayed by the display portion 5 at that time.

If and when further key operation is therefter made and the same is of a function key, then the program returns to the step E6 through the respective steps E9 and E10. At the respective steps E9 and E10, the data of the area "FKB" of the random access memory is determined to see whether the same is of the START key or the CLEAR key and if and when the same is of any of them the program immediately returns to the start routine (FIG. 15F) or the clear routine (FIG. 15J), respectively.

Since new key operation is of the START key at that time, the program shifts to the start routine.

At the first step F1 of the start routine, the opened/closed state of the door 4 of the microwave oven is determined. More specifically, if and when the signal DOR is obtained at the terminal B1 of the microprocessor at that time point, the door 4 is determined as closed and the routine proceeds to the step F2. On the other hand, if and when the signal DOR is not obtained, the routine proceeds to the step F6.

Figure 15L:
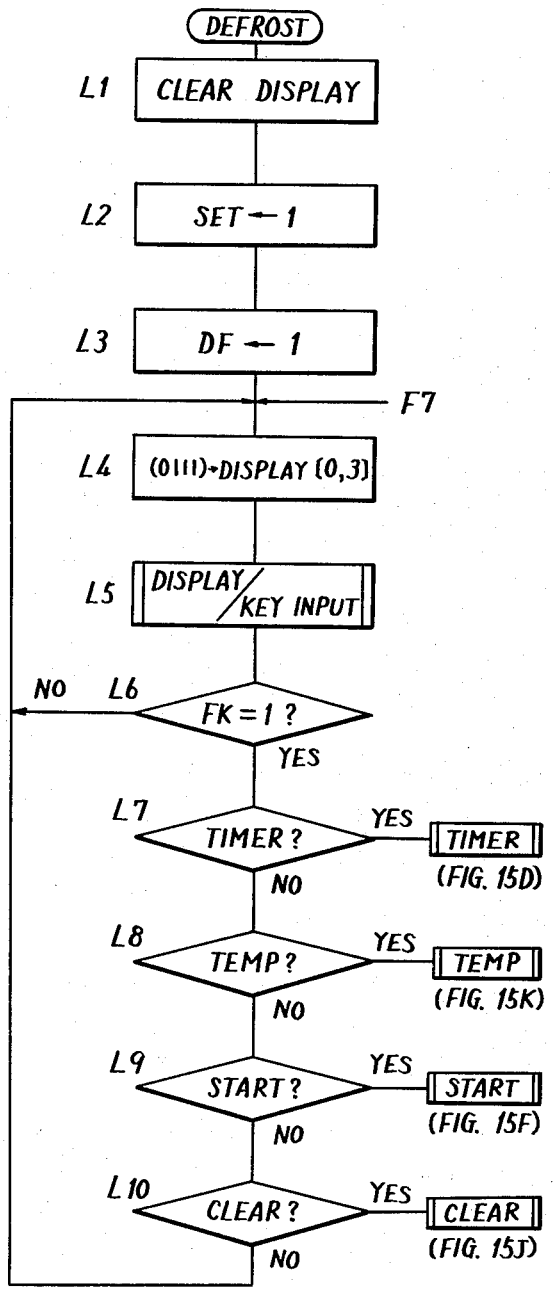

At the step F6, the content in the region TM of the random access memory is determined and if and when the same is the logic one the routine shifts to the step D2 of the timer routine (FIG. 15D), whereas if and when the same is not the logic one the routine proceeds to the step F7. At the step F7 the content in the region TP of the random access memory is determined and, if and when the same is the logic one the routine shifts to the step K2 of the temperature routine, whereas if and when the same is not the logic one the routine shifts to the step L4 of the defrost routine (FIG. 15L).

If and when the door 4 has been closed at the above described step F1, then the routine proceeds to the step F2 of the program. At the step F2 the content in the region SET of the random access memory is determined and, if and when the same is not the logic one the routine proceeds to the step F6 and if and when the same is the logic one the routine proceeds to the step F3. Since the region SET has been loaded with the logic one on the occasion of passage of the step D11 of the timer routine (FIG. 15D), the program shifts to the step F3.

At the step F3 the region DF of the random access memory is determined and, if the content therein is the logic one, the routine proceeds to the step F8 and if and when the content therein is the logic zero the routine shifts to the step F4. Since the content therein is the logic zero at that time, the routine shifts to the step F4, at which step the content in the region TEMP A of the random access memory is determined and since the content is the logic zero at that time the routine further shifts to the step F5. At the step F5 the content in the region TIMER of the random access memory is determined whether the same is the logic zero or not and, since the content therein is that the representing ten minutes and is not the logic zero at that time, the routine proceeds to the step F9.

At the step F9 the signal PO is obtained at the heat command output terminal F1 of the microprocessor. Accordingly, at that time point the microwave output is initiated and thereafter the microwave output continues until the signal PO becomes unavailable.

The program then proceeds through the respective steps F10, F11 and F12 to the step F13. At the step F10 the logic one is loaded in the region BSY of the random access memory and as a result the microwave output state is stored. At the step F11 the content in the region POWER of the random access memory is shifted to the region PWR B. Accordingly, on that occasion it follows that the numerical value 5 representing the 50% output is loaded in the region PWR B. At the step F12 the numerical value 10 is loaded in the region PWR A of the random access memory. At the step F13 the content in the region DF of the random access memory is determined as to whether the same is the logic one or not and, since the same is not the logic one at that time, the routine proceeds to the step F15. At the step F15 the content in the region TM is determined as to whether the same is the logic one or not and, since the same is the logic one at that time, the routine proceeds to the step F16.

At the step F16 the content in the region TIMER of the random access memory is transferred to the region DISPLAY and at the following step F17 exactly the same processing as that at the step A4 of the initial routine (FIG. 15A) is executed. Accordingly, since on that occasion the content in the region TIMER is that representing the timer set time period of ten minutes, a display state "1000" is obtained by the display 5 at the step F17.

In the following step F18 the content in the region BSY of the random access memory is determined and, if the same is the logic one the routine shifts to the step F19, whereas if the same is the logic zero the routine shifts to the step F51. At the step F51 the content in the region FK is determined. More specifically, if the further new key operation is not a function key operation, then immediately the routine returns to the step F13, whereas if the further new key operation is a function key operation the routine proceeds through the respective steps F52 to F55 to the step F13. At the respective steps F52 to F55 the content in the region FKD of the random access memory is checked to see whether the same is the TIMER key, the TEMP key, the CLEAR key or the START key, and if the content therein is any one of them, the routine shifts to the step F56, the step F57, the clear routine (FIG. 15J) or the start routine (FIG. 15F), respectively. At the step F56 the content in the region TP is checked and if the same is the logic one the routine shifts to the step F13, whereas if the same is the logic zero the routine shifts to the step D2 of the timer routine (FIG. 15D).

At the step F57 the content in the region TM is checked and if the same is the logic one the routine shifts to the step F13, whereas if the same is the logic zero the routine shifts to the step K2 of the temperature routine (FIG. 15K).

At the above described step F16, since the content in the region BSY is now the logic one, the routine shifts to the step F19, where the opened/closed state of the door 4 of the microwave oven is similarly checked as at the step F1, so that if the door is opened the routine shifts to the stop routine (FIG. 15G), whereas if the door is closed the routine shifts to the step F20.

In the stop routine (FIG. 15G), the logic zero is written in the region BSY of the random access memory at the first step G1 and at the following steps G2 and G3 the signals PO and TE at the heat command output terminals F1 and F0 of the microprocessor are made to disappear. As a result, microwave oscillation is terminated. Thereafter the program returns to the step F13.

Now assuming that at the above described step F19 the door 4 has been closed, the program shifts to the step F20. At the step F20 the lapse of time in terms of second is checked. More specifically, the content in the region SEC of the random access memory is checked and if the same is the logic zero the program shifts to the step F46, whereas if the same is the logic one the program shifts through the step F21 to the step F22.

At the step F21 the logic zero is written into the region SEC of the random access memory and at the step F22 the content of the region DF is checked. Since the same is the logic zero at that time, the program shifts to the step F24, where the content in the region TM is checked. Since the same is the logic one at that time, the program shifts to the step F43. At the step F43 the content in the region TIMER of the random access memory is subtracted by one second. At the following step F44 it is determined whether the content in the region TIMER is the logic zero or not and in case of the logic zero the program shifts to the buzzer routine (FIG. 15I), whereas in case where the same is not the logic zero the program shifts to the step F45. At the step F45 the power control routine (FIG. 15H) is executed by way of the buzzer routine.

When execution of the power control routine (FIG. 15H) is completed, the program shifts to the step F46 and the content in the region FK of the random access memory is checked at the said step F46, wherein if the same is the logic zero the program returns to the step F13, whereas if the same is the logic one the program shifts to the step F47. At the step F47 the content in the region FKB of the random access memory is checked to see whether or not the new function key operation is of the operation of the key STOP. If the new function key operation is of the key STOP, the program shifts to the above described stop routine (FIG. 15G) and if not the program shifts to the step F13.

Accordingly, unless a further function key operation is made, the program recirculates through the respective steps F13, F15, F16 to F20 and F46, while progress is made of each of the steps F21, F22, F24, F43 to F46 for each second in the circulation process.

In the power control routine being executed for each second, the region DF of the random access memory is checked at the first step H1. Since the content thereof is the logic zero at that time, the program shifts to the step H3. At the step H3 it is determined whether the output value has been already set or not. More specifically, the content in the region PWR of the random access memory is checked and if the same is the logic one the program shifts to the step H4 whereas if the same is the logic zero the program returns to the step F46 of the start routine. Since the content of the region PWR is the logic one at that time, the program shifts to the step H4.

At the step H4 the content in the region PWR A of the random access memory is substracted by one and at the following step H5 it is determined whether the content in the region PWR A is zero or not. If the same is zero then the program shifts to the step H6, whereas if the same is not zero the program shifts to the step H11. Since in that case "10" has been written in the region PWR A at the step F12 of the start routine, the program shifts to the step H11.

At the step H11 the content in the region PWR B of the random access memory is subtracted by one and at the following step H12 it is determined whether the content in the region PWR B is zero or not. If the same is zero, then the program shifts to the step H13, whereas if the same is not zero the program returns to the step F46 of the start routine. Since in that case the output value "5" has been written in the region PWR B at the step F11 of the start routine, the program returns to the step F46.

Since the program passes through the power control routine (FIG. 15H) at every second in the above described circulation process, the program shifts to the step H13 at the time point when the content of the region PWR B becomes "0", i.e. five seconds after the start of execution of the start routine in the above described case.

At the step H13 the signal PO at the heat command output terminal F1 of the microprocessor is caused to disappear. As a result, microwave oscillation is stopped responsive thereto. Thereafter the program returns to the step F48 of the start routine.

At the time point when the content in the region PWR A of the random access memory becomes "0", i.e. ten seconds after the start of execution of the start routine in the subsequent circulation process of the program, the program shifts to the step H6. At the step H6 "10" is written in the region PWR A of the random access memory and the subsequent step H7 the content in the region DF is checked. Since the content thereof is the logic zero at that time, the program shifts to the step H9. At the step H9 the content in the region POWER of the random access memory, i.e. the output value "5" in this case, is written into the region PWR B and at the subsequent step H10 the signal PO is obtained at the heat command output terminal F1 of the microprocessor. The program then returns to the step F46 of the start routine.

Thus the program passes the power control routine (FIG. 15H) for every second in the above described circulation process, with ten seconds as one cycle, in which one cycle microwave oscillation is made for five seconds, with the result that the output of 50% duty cycle is obtained.

On the other hand, in such circulation process the content in the region TIMER of the random access memory is subtracted one second by one second and at the time point when the content thereof becomes "0", i.e. ten minutes after the start of execution of the start routine, the program shifts to the buzzer routine (FIG. 15I) at the step F44. In the above described circulation process the content in the region TIMER is displayed at the step F17.

The content being displayed is the very time left in the timer. At the first and second steps I1 and I2 of the buzzer routine, the signals PO and TE at the output terminals F1 and F0 of the microprocessor are caused to disappear. The program then proceeds to the respective steps I3 to I5. At the step I3 the numerical value "3" representing the buzzer continuation time period of three seconds is written in the region CNT3 of the random access memory. At the step I4 the signal BZ is obtained at the buzzer output terminal F3 of the microprocessor. At the step I6 the content in the region TIMER of the random access memory is transferred to the region DISPLAY. At the subsequent step I8 exactly the same processing as that of the step A4 of the initial routine (FIG. 15A) is executed. At the further step I9 the content in the region SEC of the random access memory is checked to see the lapse in seconds. More specifically, if and when the content thereof is the logic zero the program returns to the step I5, whereas if the content thereof is the logic one the program shifts to the step I10. At the step I10 the logic zero is written into the region SEC. At the following step I11 the content in the region CNT3 of the random access memory is subtracted by "1" and at the further subsequent step I12 the content in the region CNT3 is checked. If and when the same is not "0" the program shifts to the step I5, whereas if the same is "0" the program shifts to the step I13. At the step I13 the signal BZ at the buzzer output terminal F3 of the microprocessor is caused to disappear.

Therefore, upon initiation of execution of the buzzer routine (FIG. 15I), microwave oscillation is stopped and the buzzer is driven, while the program makes circulation of the respective steps I5, I6, I8 and I9 and in the circulation process the program passes through the respective steps I10, I11 and I12 at every lapse of one second, whereupon the program shifts to the step I15 to stop buzzer driving at the time point when the content in the region CNT3 of the random access memory becomes "0", i.e. three seconds after the start of execution of the buzzer routine (FIG. 15I). The program then shifts to the clear routine (FIG. 15J).

At the step J1 of the clear routine all the regions in the random access memory, excluding those regions CLOCK, CNT1 and CNT2, are cleared, whereby the program thereafter returns to the step A2 of the initial routine (FIG. 15A).

Thus the program circulates the respective steps A2, A3, A4 and A5, unless a new further key operation is made thereafter, so that the current time is displayed by the display 5 in the circulation process. More specifically, the microwave oven completes all of the above described timer operation, thereby to enter into a standby state.

TEMPERATURE OPERATION

In the case where operation is made until the temperature of a material being cooked becomes 90° C. with the 50% output value of the maximum microwave output, the following key operation is made in succession by the control panel 6.

[TEMP] [9] [0] [POWER] [5] [START]

In the following the progress of the program in accordance with the above described key operation sequence will be described.

The program has been making circulation of the respective routines A2 to A5 of the initial routine (FIG. 15A), as described previously, and, therefore, if and when the key TEMP is operated, the key operation is detected at the step A4, so that the program shifts through the respective steps A5, A6 and A7 to the step A8. At the step A8, the content in the region FKB of the random access memory is checked to see whether the above described operation key is the key TEMP or not. Since the operated key is the key TEMP in that case, the program shifts to the temperature routine (FIG. 15K).

At the first step K1 of the temperature routine (FIG. 15K), "0" is written in all the regions DISPLAY of the random access memory, so that the content thereof is cleared, whereupon the program shifts in succession to the respective steps K2, K3 and K4. At the step K2 the content in the region TEMP A of the random access memory is transferred to the DISPLAY regions [0,3], [0,2] and at the step K3 the logic one is written in the region TP of the random access memory and at the step K4 exactly the same processing as that of the step A4 of the initial routine is executed, whereupon the program shifts to the step K5.

At the step K5 the content in the region FK of the random access memory is checked and, if the same is the logic zero the program shifts to the step K9, whereas if the same is the logic one the program shifts to the step K6. At the step K9 the content in the region NK of the random access memory is checked and if the same is the logic zero the program shifts to the step K2, whereas if the same is the logic one the program shifts to the step K10.

In leaving the above described step K4, unless a new further key operation is made, the contents in the respective regions FK and NK of the random access memory are the logic zero, so that the program makes circulation of the respective steps of K2, K3, K4, K5 and K9, whereby "0" is displayed by the display 5. When a further operation is made of the numeral key (9), such operation is detected by the above described step K4, so that the program passes through the respective steps K5, K9, K10 and K11 to return to the step K2. At the step K10 the content in the respective digits in the region TEMP A of the random access memory is shifted by one digit toward the more significant digit and at the same time the content in the region NKB of the random access memory is written in the first digit [0, 7] of the region TEMP A of the random access memory. At the step K11 the logic one is written in the region SET of the random access memory, whereby it is stored that a temperature numerical value of at least one digit is inputted.

Thereafter the program makes again circulation of the respective steps K2, K3, K4, K5 and K9 until a new further key operation is made and during that process the content in the region TEMP A is displayed.

Similarly thereafter, when the numeral key "0" is operated, a display state "90" representing the preset temperature of 90° C. is displayed by the display 5, while the program makes circulation of the respective steps K2, K3, K4, K5 and K9. When a new further key operation is made thereafter, which is a function key operation, the program passes through the respective steps K6, K7 and K8 to return to the step K2.

At the respective steps K6, K7 and K8, the content in the region FKB of the random access memory is determined to check whether the same is the POWER key, the START key or the CLEAR key, and in the case where the same is any one of them, the program immediately shifts to the power routine (FIG. 15E), the start routine (FIG. 15F) or the clear routine (FIG. 15J).

Since in the above described case a new further key operation is the POWER key operation, the program shifts to the power routine (FIG. 15G) and, since the region SET of the random access memory is the logic one, the region TIMER is "0" and the region TEMP A is not "0", the program enters into the step E5. Accordingly, at the time point of a key operation of "5" following the key POWER, the numerical value "5" representing the output value of 50% is written in the region POWER of the random access memory, as in case of the above described timer operation and at the same time the logic one is written into the region PWR, while "5" is displayed by the display.

The program has been making circulation of the respective steps E6, E7, E8 and E11 and by the subsequent operation of the key START the program shifts through the step E9 to the start routine (FIG. 15F).

When the program enters in the start routine, the program makes successive progress of the respective steps F1 to F4, whereupon the program shifts to the step F8. At the said step the signal TE is generated at the output terminal F0 of the microprocessor. Accordingly, the relay coil 39 is energized and relay contact 391 is turned on, while the chopper motor 235 is energized, so that the chopper 401 starts rotation. On the other hand, the inhibiting circuit 357 becomes operable responsive to the signal INH, so that the temperature output MT is fixed to −10 V for a predetermined time period. Although the output value corresponds to −20° C., the same is not the actual temperature of a material being cooked as a matter of course.

The program then shifts to the step F9 and at this step microwave oscillation is started. The program thereafter shifts through the respective steps F10 to F13 and F15 to the step F14. At the step F14 the contents in the TEMP B regions [1, 7] and [1, 6] are transferred to the DISPLAY region [0, 3] and [0, 2] and the content in the region RD is transferred to [0, 1] of the region DISPLAY.

Thereafter the program makes circulation of the respective steps F17, F18, F19, F20, F46, F13, F15 and F14, as in the case of the timer operation and during the above described circulation process the program enters into the step F21 for every second. After the step F21 the program shifts through the step F22 to the step F24 and, since the content in the region TM is the logic zero at that time, the program shifts to the step F23.

At the step F23 the logic zero is written into all the bits in the region TCNT of the random access memory and at the subsequent step F25 the content in the region TCNT, excluding the most significant bit, is outputted at the output terminals G0 to G3 and H0 to H2 of the microprocessor. More specifically, the count signals SG0 to SG6 of the seven bits are outputted as (0, 0, 0, . . . 0), so that a value of −10 V corresponding to −20° C. is obtained at the output terminal 331 of the polygonal line analogous circuit 33.

At the following step F26 it is determined whether the output signal MTE of the comparator 37 has been obtained or not and, if the signal MTE is not obtained the program shifts to the step F27, whereas if the signal MTE is obtained the program shifts to the step F28. Since the temperature output of the temperature output circuit 35 is −10 V at that time, the signal MTE is obtained and accordingly the program shifts to the step F28.

At the step F28 the content of 8-bits in the region TCNT of the random access memory is converted into a decimal number and is written into the region TEMP B. More specifically, at that time the content in the above described region is "0". At the following step F29, "20" is subtracted from the content in the region TEMP B and at the same time the sign of the subtraction result is written into the region RD of the random access memory. More specifically, if the content in the region RD is a plus sign, the binary representation is (0000) and if the content in the region RD is a minus sign, a binary representation is (1111). Accordingly, in the above described case the content in the region TEMP B is "20" and the content in the region RD is a redundant numerical value of "15".

The program then shifts to the step F33 and at that step it is determined whether the content in the region DF of the random access memory is the logic one. Since the same is the logic zero at that time, the program shifts to the step F42. At the step F42 the content in the region TEMP B of the random access memory, including the sign thereof, is compared with the content in the region TEMP A and, if the former is equal to or larger than the latter, the program shifts to the buzzer routine (FIG. 15I), whereas otherwise the program shifts to the step F45. Since in the above described case the content in the region TEMP A, i.e. 90° C., is larger, the program shifts to the step F45 and at that step the power control routine (FIG. 15H) is executed as in the case of the timer operation, whereupon the program shifts through the step F46 to the step F 13.

Thus the program makes circulation of the respective steps F13, F15, F14, F17 to F20 and F46 and during the above described circulation process at every one second the program passes from the step F20 through the respective steps F21, F22, F24, F23, F25, F26, F28, F29, F33 and F42 and through the power control routine of the step F45, thereby to perform microwave oscillation of 50% output. During the above described circulation process, the content in the region TEMP B is displayed at the step F17 together with a sign (only in case of a minus sign). More specifically, in the above described case, the display manner is "−20". Meanwhile, it is assumed that the door 4 of the microwave oven has been closed during that period and the STOP key has not been operated.

Thereafter the inhibiting circuit 357 is released from inhibition. The time period until such release of inhibition is about several seconds, as described previously. Therefore, the temperature output MT becomes suited for a proper temperature of a material being cooked. Now assuming that the temperature is 30° C., the count signals SG0 to SG6 still correspond to −20° C. and therefore the signal MTE is not obtained from the comparator 37. Accordingly, at the step F26 of the above described circulation process, the program shifts to the step F27 and then returns to the step F25. At the step F27, "1" is added to the region TCNT of the random access memory.

Therefore, the program makes circulation of the respective steps F25, F26 and F27, until the count signals SG0 to SG6 become the logical state corresponding to the current temperature of 30° C. of a material being cooked and when the material being cooked reaches that temperature the program shifts to the step F28.

At the step F28, similarly the binary number in the region TCNT is converted into a decimal number and is written into the region TEMP B and at the following step F29 "20" 1 is subtracted from the content in the region TEMP B and at the same time the sign of the subtraction result 1 is written into the region RD of the random access memory. More specifically, in the above described case "30" is written into the region TEMP B and "0" is written into the region RD. The program thereafter shifts through the respective steps F33, F42, F45 and F46 to return to the step F13 and at the step F17 the numerical value "30" representing the temperature 30° C. of a material being cooked is displayed.

Accordingly, the program makes circulation of the respective steps F13, F15, F14, F17 to F20 and F46 and during the above described circulation process at every one second the program shifts from the step F20 to the step F21, so that measurement is made of the temperature of a material being cooked and comparison is made of the measured temperature with a preset temperature, while the above described power control routine (FIG. 15H) is executed. The measured temperature is displayed by the step F17.

When the temperature of a material being cooked reaches thereafter a preset temperature of 90° C., the same is detected at the step F42 and the program shifts to the buzzer routine (FIG. 15I).

At the buzzer routine, as in the case of the timer operation, microwave operation is terminated at the step I1 and the signal TE is caused to disappear at the step I2, whereby the chopper motor 235 is also brought to a stop. The program then proceeds to the respective steps I3, I4 and I5 and at the step I5 the content in the region TM of the random access memory is checked. Since the same is the logic zero in the above described case, the program shifts to the step I7. At the step I7 the content in the region TEMP B of the random access memory is transferred to the region DISPLAY and the program then shifts to the step I8.

Through execution of the buzzer routine the buzzer is driven for three seconds as described previously and thereafter the program proceeds through the above described clear routine (FIG. 15J) and makes circulation of the respective steps A2, A3, A4 and A5 of the initial routine (FIG. 15A), whereby during the above described circulation process the current time is displayed by the display 5. More specifically, the microwave oven completes all of the above described temperature operation, thereby to enter a standby state.

DEFROST OPERATION

In order to defrost a frozen food material, key operation is made in succession by the operation portion 6 in the following manner.

DEFROST START

Meanwhile, according to the present defrosting operation, the time point when the temperature of a material being cooked is heated to 3° C. is assumed to be a defrosting middle point, the time point when a material being cooked is heated to 8° C. is assumed to be a defrosting end point and microwave oscillation is made with the 100% output up to the defrosting middle point and with the 20% output thereafter up to the defrosting end point.

In the case where defrosting is made using a microwave, the dielectric constant of ice and water is "2.2" and "77", with the dielectric constant of air deemed as "1", and since these two dielectric constants of ice and water are largely different from each other, when defrosting proceeds in part, microwave is concentratedly absorbed by a molten water portion, so that partial defrosting is increasingly expedited, with a disadvantageous result of uneven defrosting. Although such uneven generation of defrosting can be decreased by performing defrosting with a small microwave output, a defrosting time period is considerably prolonged on the other hand.

By contrast, by dividing the defrosting step into two steps, as in case of the embodiment shown, a proper defrosting state can be achieved with a short period of time. More specifically, although defrosting is made quickly with the high output until a material being cooked becomes 3° C., at the temperature in the vicinity thereof a material being cooked is still in a frozen state and partial defrosting very little occurs, and in the vicinity of 3° C. water comes to be generated by virtue of partial defrosting, so that thereafter defrosting is made with a low output until a material being cooked becomes the proper defrosting end temperature of 8° C. Thus, according to the embodiment in discussion, while there is no fear of expediting uneven defrosting, the defrosting processing is made with a high output, whereas if there is such a fear the defrosting processing is made with a low output, thereby to perform a short time defrosting processing. The above described temperature of the above described defrosting middle point and the defrosting end point for that purpose may be properly changed.

Now in the following the progress of the program will be described in accordance with the above described key operation sequence. The program has been making ciculation of the respective routines A2 to A5 of the initial routine (FIG. 15A) as described previously, and therefore when the DEFROST key is operated, the key operation is detected at the step A4, so that the program proceeds through the respective steps A5 to A8 to the step A9. At the step A9 the content in the region FKB of the random access memory is checked to see whether the above described operated key is the DEFROST key or not, and if the operated key is the DEFROST key the program proceeds to the defrosting routine (FIG. 15L) and if not the program returns to the step A2. In the above described case, since the operated key is the DEFROST key, the program shifts to the defrosting routine.

At the first step L1 of the defrosting "0" is written in all of the region DISPLAY of the random access memory, whereby the content in the said region is cleared.

The program then proceeds in succession to the respective steps L2 to L6. At the respective steps L2 and L3 the logic one is written into the respective regions SET and DF of the random access memory. At the step L4 a redundant numerical value "12", i.e. a binary representation of (0111) for representing the character "F" is written in the first digit [0, 3] of the region DISPLAY of the random access memory and at the following step L5 exactly the same processing is made as that of the step A4 of the initial routine (FIG. 15A). At the step L6 the content in the region FK of the random access memory is checked and if the same is the logic zero the program shifts to the step L4, whereas if the same is the logic one the program shifts to the step L7.

Upon leaving the above described step L5, unless a new further key operation is made, the content in the region FK is the logic zero and therefore the program makes circulation of the respective steps L4, L5 and L6, so that "F" meaning DEFROST is displayed by the display 5.

If and when a new further key operation is made which is of a function key, then the program proceeds through the respective steps L7 to L10 to return to the step L4. At the respective steps L7, L8, L9 and L10, the content in the region FKB of the random access memory is checked to see whether the same is of the TIMER key, the TEMP key, the START key or the CLEAR key or not, and in the case where the same is any one of them, immediately the program shifts to the timer routine (FIG. 15D), the temperature routine (FIG. 15K), the start routine (FIG. 15F) or the clear routine (FIG. 15J), respectively.

Since in the above described case a new further key operation is of the START key, the program shifts to the start routine.

In the start routine, similary the program proceeds through the respective steps F1 and F2 to the step F3 and at the step F3 the content in the region DF of the random access memory is checked. Since the content in the region DF is the logic one in the above described case, the program shifts to the step F8 and proceed through the further steps F9 to F12 to the step F13. At the step F13 the content in the region DF of the random access memory is checked. Since the content in the region DF is the logic one in the above described case, the program shifts to the step F14 and thereafter as in the case of the above described respective operations the program makes circulation of the respective steps F17 to F20, F46, F13 and F14 and during the above described circulation process the program enter into the step F21 at every one second. After the step F21 the content in the region TF of the random access memory is checked at the step F22. Since the same is the logic one in the above described case, the program shifts to the step F23. Thereafter similarly the program shifts to the step F33. At the step F33 the content in the region DF of the random access memory is checked. Since the same is the logic one in the above described case, the program shifts to the step F34. At the step F34 it is determined whether the temperature corresponding to the content in the region TEMP B of the random access memory exceeds 8° C. or not and if the temperature exceeds 8° C. the program proceeds to the step F35, whereas if the temperature is lower than 8° C. the program shifts to the step F37. At the step F37 it is determined whether the temperature corresponding to the content in the region TEMP B exceeds 3° C. or not and if the temperature exceeds 3° C. the program shifts to the step F38, whereas if the temperature is lower than 3° C. the program shifts to the step F45.

Since the temperature output MT is that corresponding to −20° C. by virtue of the operation of the inhibiting circuit 357, the program shifts through the respective steps F34 and F37 to the step F45 and at the step F45 the program enters into the power control routine (FIG. 15H).

At the step H1 of the power control routine the content in the region DF of the random access memory is checked and, since the same is the logic one in the above described case, the program shifts to the step H2. At the step H2 the content in the region DPWR is checked and if the same is the logic one the program shifts to the step H4, whereas if the same is the logic zero the program shifts to the step F46. Since the content in the region DPWR is the logic zero in the above described case, the program shifts to the step F46 and returns from the step F46 to the step F13.

Thus the program makes circulation of the respective steps F13, F14, F17 to F20 and F46 and during the circulation process the program proceeds from the step F20 through the respective steps F21, F22, F23, F25, F26, F28, F29, F33, F34 and F37 at every one second and enters into the power control routine at the step F45. Since the program directly shifts in the routine from the step H21 to the step F46, microwave oscillation is performed with the 100% output. During the above described circulation process the content in the region TEMP B is displayed together with a sign thereof at the step F17. More specifically, in the above described case, the display manner is "−20".

Meanwhile, it is assumed that during that period the door 4 of the microwave oven has been placed in a closed state and the STOP key has not been operated.

When the inhibition by the inhibiting circuit 357 is thereafter released, the temperature output MT becomes one associated with a proper temperature of a material being cooked. Accordingly as in the previous case of temperature operation, measurement of temperature is made at every second and comparison is also made to determine whether or not the measured temperature has exceeded 8° C. and 3° C. It is pointed out that the microwave output at that time is 100%. The measured temperature is displayed at the step F17 and if the temperature is a minus temperature a minus sign is also displayed.

If and when the temperature of a material being cooked reaches 3° C. thereafter, the program shifts from the step F37 to the step F38. At the step F38 the content in the region DPWR of the random access memory is checked and if the same is the logic one the program shifts to the step F45, whereas if the same is the logic zero the program shifts to the step F39. Since the content in the region DPWR of the random access memory is the logic zero in the above described case, the program shifts to the step F39 and thereafter proceeds through the respective steps F40 and F41 to the step F45. At the respective steps F39 and F40 the logic one and "2" are written in the respective regions DPWR and PWRD of the random access memory and at the step F41 the content in the region PWRD is written into the region PWRD.

In the power control routine (FIG. 15H) started at the step F45, at the step H2 following the step H1 it is determined that the content in the region DPWR is the logic one and the program proceeds to the step H4. Accordingly, as is apparent from the foregoing, the program passes the power control routine at every one second and at the time point when the content in the region PWR D becomes "0", i.e. in the above described case two seconds after the start of execution of the start routine (FIG. 15F) the program shifts to the step H12 and at that step H12 microwave oscillation is stopped. At the time point when the content in the region PWR A of the random access memory becomes "0", i.e. ten seconds after the start of execution of the start routine, the program shifts from the step H5 to the step H7 and at the step H7 the content in the region DF is checked. Since the content in the region DF is the logic one in the above described case, the program shifts to the step H8 and at the step H8 the content "2" of the region PWRD is written into the region PWR B, so that at the following step H10 microwave oscillation is restarted.

After the temperature of a material being cooked reaches 3° C., similarly the program proceeds in succession from the step F21 to the step F29 one time per one second and the program further proceeds through the respective steps F33, F34, F37 and F38 and shifts from the step F38 to the step F45, and accordingly one time per each second the temperature is measured and comparison is made to determine whether or not the measured temperature has reached 8° C. and 3° C., whereupon microwave oscillation is performed with the 20% output. The measured temperature is displayed at the step F17.

When the temperature of a material being cooked reaches 8° C. thereafeter, the program shifts from the step F34 to the step F35 and further through the step F36 to the step F4. At the step F35 the logic zero is written into the region DF of the random access memory and at the step F36 the signal TE at the output terminal F0 of the micrprocessor disappears.

The program further shifts to the step F4, where the content in the region TEMP A is checked. Since the same is "0" in the above described case, the program then shifts to the step F5 and at the step F5 the content in the region TIMER is checked. Since the same is "0" in the above described case, the program further shifts to the buzzer routine (FIG. 15I).

In the buzzer routine the same processing as the previously described TEMPERATURE OPERATION is performed and thereafter the program proceeds through the clear routine (FIG. 15J) and makes circulation of the respective steps A2, A3, A4 and A5 of the initial routine (FIG. 15A), while during the above described circulation process the current time is displayed by the display (15). More specifically, the microwave oven completes all of the above described defrosting operation, thereby to enter into a standby state.

COMBINATION OF DEFROSTING OPERATION AND TIMER OPERATION

In the case where following defrosting of a frozen food material the same is subjected to the maximum microwave output of 80% output value for five minutes, the following key operation is made in succession by the operation portion 6.

[DEFROST] [TIMER] [5] [0] [0] [POWER] [8] [START]

In such case, after performance of the above described DEFROST OPERATION the above described TIMER OPERATION is to be performed, as is readily understood.

COMBINATION OF DEFROST OPERATION AND TEMPERATURE OPERATION

In case where following defrosting of a frozen food material the same is subjected to the maximum microwave output of 60% output value until the material being cooked is heated to the temperature of 85° C., a key operation is made in succesion as follows by the operation portion 6.

[DEFROST] [TEMP] [8] [5] [POWER] [6]

In such case, after performance of the above described DEFROST OPERATION the above described TEMPERATURE OPERATION is to be performed, as is readily understood. Meanwhile, when the TEMPERATURE OPERATION is thus commanded following the DEFROST OPERATION, the apparatus may be adapted such that the chopper 401 (FIG. 7) and thus the synchronous motor 235 (FIG. 2) is continually energized.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronic controlled heat cooking apparatus, comprising:

heating energy generating means for providing heating energy to a material being cooked, entry means for entering information for controlling said heating energy generating means, storing means for storing data, an infrared radiation detecting device for receiving an infrared radiation from said material being cooked, voltage generating means for generating a voltage associated with the output from said infrared radiation detecting device, analog voltage generating means for generating an analog voltage changing in a linear manner, correcting means for correcting said linearly changing voltage to a voltage analogous to the output voltage characteristic of said infrared radiation detecting device, comparing means for comparing said corrected analog voltage and said voltage associated with said output of said infrared radiation detecting device, temperature data providing means for providing corresponding temperature data responsive to said corrected analog voltage if and when said comparing means detects substantial coincidence of said corrected analog voltage and said output associated voltage, loading means for loading set temperature data from said entry means to said storage means when a temperature operation is commanded by said entry means, and heat control means responsive to said set temperature data loaded in said storage means and temperature data provided by said temperature data providing means for controlling said heating energy generating means.

2. An apparatus in accordance with claim 1, wherein said analog voltage generating means comprises:

digital data generating means for generating digital data of a predetermined number of bits counted up in succession at a given period, and digital/analog converting means for generating a stepwise voltage responsive to digital data from said digital data generating means.

3. An apparatus in accordance with claim 2, wherein the output voltage characteristic of said infrared radiation detecting device exhibits a curve relation with respect to the temperature, and said correcting means comprises polygonal line analogous circuit means for attaining said curve by way of a polygonal line analogous curve.

4. An apparatus in accordance with claim 3, wherein said polygonal line analogous circuit means exhibits a characteristic wherein said curve is divided into a plurality of straight line portions, each having a corresponding gradient, whereby a polygonal analogous curve is attained.

5. An apparatus in accordance with claim 2, wherein said temperature data providing means is adapted such that if and when the voltage associated with the output voltage from said infrared radiation detecting device and said stepwise changing analog voltage substantially coincide with each other said digital data of a predetermined number of bits is adopted as temperature data of said material being cooked.

6. An apparatus in accordance with claim 1, wherein said heat control means comprises stop means responsive to an output of a predetermined temperature detecting means for disabling said heating energy generating means, and which further comprises end notifying means responsive to a stop of said heating energy for notifying the end of the cooking operation.

7. An apparatus in accordance with claims 1 or 6, wherein said predetermined temperature detecting means comprises means for detecting whether said temperature of said material being cooked has reached said set temperature loaded in said storage means, and said heat control means is adapted to generate stronger heating energy by said heating energy generating means until the output is obtained from said predetermined temperature detecting means and to generate weaker heating energy by said heating energy generating means when the output is obtained from said predetermined temperature detecting means.

8. An apparatus in accordance with claim 1, which further comprises:

digital display means, and displaying means for displaying said temperature data from said temperature data providing means by said digital display means.

9. A method as in claim 1, wherein said entry means further comprises means for commanding a defrost cooking mode operation, said method further comprising the steps of:

providing said linearly varying analog voltage during a defrost operation in response to an operation of said defrost operation commanding means, controlling said heating energy generating means during said defrost operation responsive to said temperature data provided by said comparing step, and controlling said heating energy generating means so as to automatically shift after said defrost operation to said temperature operation when said defrost operation and said temperature operation are commanded by said entry means.

10. A method in accordance with claim 9, wherein said heat cooking apparatus further comprises digital display means, further comprising the step of displaying the temperature of said material being cooked, as represented by said temperature data, by means of said digital display means in said defrost operation and said temperature operation.

11. A method in accordance with claim 9, wherein said entry means further comprises means for commanding a desired intensity of heating energy generated by said heating energy generating means, said method further including the step of:

controlling said heating energy generating means to operate at said desired intensity when executing said temperature operation following said defrosting operation.

12. A method in accordance with claim 9, wherein said entry means further comprises means for entering a preset time period and for commanding a timing operation, and said method further comprises the steps of:

controlling said heating energy generating means, responsive to an operation of said defrost operation commanding means and timing operation commanding means, for executing in succession said defrosting operation and said timing operation, and disabling said heating energy generating means after the lapse of said preset time period in said timing operation.

13. A method in accordance with claim 12, wherein said heat cooking apparatus further comprises digital display means, and wherein said method further comprises the steps of:

displaying said preset time period by said digital display means responsive to an operation of said timing operation commanding means, timing a heating time period after said timing operation is started, and displaying by said digital display means a time period left for energization of said heating energy generating means responsive to said preset time period and said heating time period.

14. A method in accordance with claim 12, wherein said entry means further comprises means for commanding a desired intensity of heating energy generated by said heating energy generating means, and said method further comprises the step of:

controlling said heating energy generating means to operate at said desired intensity when executing said timing operation following said defrosting operation.

15. A method in accordance with claim 12, wherein said infrared radiation detecting device comprises:

chopper means for chopping in a predetermined cycle said infrared radiation transmitted from said material being cooked to said infrared radiation detecting device, and wherein said method further comprises:

enabling said chopper means only in executing said defrosting operation and said temperature operation.

16. A microwave oven, comprising: input means for commanding at least a defrosting operation, a temperature operation, a timing operation, and an operation initiation, digital display means, microwave generating means for providing heating energy to a material being cooked, an infrared radiation detecting device for detecting an infrared radiation emitted from said material being cooked, chopper means for chopping in a predetermined cycle said infrared radiation emitted from said material being cooked to said infrared radiation detecting device, and microprocessor means including a processing means and a storage means for storing the content of the command entered from said input means in said storage means and for:

(a) determining the content of said command stored in said storage means, (b) enabling said chopper means, (c) energizing said microwave generating means, (d) measuring a temperature of said material being cooked responsive to the output from said infrared radiation detecting device, (e) determining whether the temperature of said material being cooked exceeds a temperature as set by said input means, (f) determing whether the temperature of said material being cooked has reached a predetermined temperature, (g) evaluating a time period left for energization of said microwave generating means based on the time period set by said input means in said timing operation, (h) displaying said evaluated time period left by said digital display means, (i) determining whether said time period left has become zero, (j) deenergizing said microwave generating means, and (k) disabling said chopper means, and (A) said microprocessor means, when said operation initiation is commanded by said input means, executing said function (a); when said commanded operation contains said defrosting operation, executing said functions (b), (c), (d), and (e); when the temperature of said material being cooked does not reach said predetermined temperature in said function (f), repeating said function (d), and (f); and when the temperature of said material being cooked has reached said predetermined temperature in said function (f), when neither said timing operation nor said temperature operation is commanded, executing said function (j), when said temperature operation is not commanded, executing said function (k), and when the temperature of said material being cooked has reached said predetermined temperature in said function (f), said function is executed in spite of the operation as commanded other than said defrosting operation, and on the occasion of said function (c), executing said function (b), (B) when said timing operation is commanded in said function (a), executing said functions (h), (g) and (i); when said time period left is not zero in said function (i), repeating said functions (h), (g) and (i); and when said time period left becomes zero in said function (i), executing said function (j), or (C) when the temperature operation is commanded in said function (a), executing said functions (d), and (e); when the temperature of said material being cooked has not reached a temperature preset by said input means in said function (e), repeating said functions (d), and (e); and when the temperature of said material being cooked has reached the temperature preset by said input means in said function (e), executing said functions (j) and (k), and wherein said storage means further comprises a predetermined program for said defrosting operation, and said microprocessor means further comprises means for varying the intensity of a microwave provided by said microwave generating means in accordance with said predetermined program in executing said defrosting operation.

17. A microwave oven in accordance with claim 16, wherein said microprocessor means further comprises means for:

determining whether the temperature of said material being cooked as measured in said function (d) has reached a temperature corresponding to a defrosting intermediate point, rendering the intensity of a microwave provided from said microwave generating means to a relatively strong first intensity until the temperature of said material being cooked reaches a temperature corresponding to said defrost intermediate point, and rendering the intensity of a microwave provided by said microwave generating means to a relatively weak second intensity after the temperature of said material being cooked exceeds a temperature corresponding to said defrost intermediate point until the temperature of said material being cooked reaches said predetermined temperature.

18. A method for controlling a heat cooking apparatus comprising entry means for commanding a temperature cooking mode operation, heating energy generating means for providing heating energy to a material being cooked, and an infrared radiation detecting device for detecting infrared radiation emitted from said material being cooked, said method comprising the steps of:

providing an analog voltage which is changing in a linear manner in response to an operation of said entry means correcting said linearly changing analog voltage to be similar to a detecting characteristic of said infrared radiation detecting device, comparing said corrected analog voltage and said output voltage obtained from said infrared radiation detecting device for providing temperature data corresponding to said corrected analog voltage if and when both substantially coincide with each other, and controlling said heating energy generating means for performing said temperature cooking mode operation in response to said provided temperature data.

19. A method in accordance with claim 18, wherein said heat cooking apparatus further comprises storing means for storing a given temperature value for said temperature cooking mode operation, said method further comprising the step of storing said given temperature value in said storing means prior to said initiation of said temperature cooking mode operation, and wherein said heating energy generating means controlling step comprises the steps of:

generating the heating energy from said heating energy generating means with a first energy intensity until said provided temperature data from said material being cooked becomes said given temperature value, and generating the heating energy from said heating energy generating means with a second energy intensity if and when said provided temperature data from said material being cooked exceeds said given temperature value.

20. A method in accordance with claim 19, wherein said temperature cooking mode operation includes a defrost cooking mode operation, and said first energy intensity is selected to be larger than said second energy intensity.

21. A method in accordance with claim 18, wherein said detecting characteristic is such that the voltage from said infrared radiation detecting device changes in a curve relation with respect to the temperature of said material being cooked, and said step for correcting said linearly changing analog voltage to a voltage similar to the detecting characteristic of said infrared radiation detecting device comprises the step of dividing said characteristic into a plurality of straight line portions which are analogous to said curve in a polygonal manner, whereby analogy is attained by straight line portions each having the corresponding gradient of each said divided portion.

22. A method in accordance with any one of claims 18, 19, 20, or 21, wherein said heat cooking apparatus further comprises digital display means, said method further comprising the step of displaying said provided temperature data from said material being cooked by said digital display means during said temperature operation.

23. An electronic controlled heat cooking apparatus comprising:

heating energy generating means for providing heating energy to a material being cooked, entry means for entering information for controlling said heating energy generating means, storage means for storing at least a predetermined temperature data, first voltage generating means for generating a first voltage corresponding to said predetermined temperature data stored in said storage means, an infrared radiation detecting device for receiving an infrared radiation from said material being cooked, second voltage generating means for generating a second voltage associated with the output from said infrared radiation detecting device, approximating means for approximating said first voltage to an output characteristic of said second voltage to generate a third voltage, comparing means for comparing said approximated third voltage and said second voltage, controlling means responsive to an output of said comparing means for controlling said heating energy generating means.

* * * * *

UNITED STATES PATENT AND TRADEMARK OFFICE

CERTIFICATE OF CORRECTION

PATENT NO. : 4,383,157

DATED : May 10, 1983

INVENTOR(S) : Takeshi Nakata et al

It is certified that error appears in the above-identified patent and that said Letters Patent are hereby corrected as shown below:

Claim 9, column 33, line 12, change "1" to -- 18 --;

Claim 16, column 34, line 44, change "determing" to -- determining --.

Signed and Sealed this

*Nineteenth* Day of *February 1985*

[SEAL]

*Attest:*

DONALD J. QUIGG

*Attesting Officer*

*Acting Commissioner of Patents and Trademarks*